US006625285B1

(12) United States Patent
Ohashi

(10) Patent No.: US 6,625,285 B1
(45) Date of Patent: Sep. 23, 2003

(54) ACOUSTIC COOLING SYSTEM WITH NOISE REDUCTION FUNCTION

(75) Inventor: Tadashi Ohashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/047,404

(22) Filed: Mar. 25, 1998

(30) Foreign Application Priority Data

Oct. 16, 1997 (JP) ..... 9-284086

(51) Int. Cl.[7] ..... G10K 11/16
(52) U.S. Cl. ..... 381/71.3; 381/71.1; 381/71.11
(58) Field of Search ..... 381/71.3, 71.1, 381/71.11

(56) References Cited

U.S. PATENT DOCUMENTS

| | | | | |
|---|---|---|---|---|
| 5,093,864 A | * | 3/1992 | Sekiguchi et al. | 381/71 |
| 5,127,235 A | * | 7/1992 | Nakanishi et al. | 381/71 |
| 5,174,130 A | * | 12/1992 | Lucas | 62/498 |
| 5,499,301 A | * | 3/1996 | Sudo et al. | 381/71 |
| 5,649,016 A | * | 7/1997 | Nagami et al. | 381/71.11 |
| 5,668,747 A | * | 9/1997 | Ohashi | 364/724.19 |

FOREIGN PATENT DOCUMENTS

| | | |
|---|---|---|
| JP | 4-224279 | 8/1992 |
| JP | 6-8581 | 1/1994 |

OTHER PUBLICATIONS

N. Nakane "Noise Preventing Mechanism of Image Forming Apparatus," Japanese Patent Laid–Open (Kokai) HEI 06–8581 Laid–Open Date: Jan. 18, 1994.

T. S. Lucas Japanese Patent Laid–Open (Kokai) HEI 04–224279 Laid–Open Date: Aug. 13, 1992.

T. J. Hofler, et al. "Acoustic Cooling Engine," U. S. Patent No. 4,722,201 Date of Patent: Feb. 2, 1988.

U. S. Patent No. 5,174,130 Date of Patent: Dec. 29, 1992.

* cited by examiner

*Primary Examiner*—Forester W. Isen
*Assistant Examiner*—Laura A. Grier
(74) *Attorney, Agent, or Firm*—Staas & Halsey LLP

(57) ABSTRACT

The invention provides an acoustic cooling system with a noise reduction function of the type wherein a driving condition of a sound source used in the acoustic cooling system is controlled to compress coolant by a sound wave and a cooling object is cooled making use of an endothermic action of the coolant when the compressed coolant is expanded and which can reduce noise produced from the sound source effectively. To this end, the acoustic cooling system forwards cancellation sound having a characteristic capable of offsetting or cancelling the noise originating from the sound source and includes a cancellation signal production element for producing, in accordance with a driving control signal produced by a sound source control element, a cancellation signal having a characteristic capable of cancelling the noise produced as the sound source is driven, a cancellation signal level adjustment element for adjusting the signal level of the cancellation signal in accordance with the driving control signal, and a cancellation sound outputting element for converting the cancellation signal having the adjusted signal level into a sound wave and outputting the sound wave as the cancellation sound for the noise.

37 Claims, 10 Drawing Sheets

ACOUSTIC COOLING SYSTEM WITH NOISE REDUCTION FUNCTION

BACKGROUND OF THE INVENTION

1. Field of the Invention

This invention relates to an acoustic cooling system which cools a cooling object making use of an endothermic action when desired coolant in the form of gas, liquid or the like contained in a vessel expands after a sound wave (acoustic oscillatory wave) is forwarded into the vessel to compress the coolant in the vessel, and more particularly to an acoustic cooling system with a noise reduction function by which noise produced when a sound wave is forwarded into a vessel can be reduced.

2. Description of the Related Art

FIG. 9 is a perspective view schematically showing an example of an appearance of a typical acoustic cooling system, and FIG. 10 is a diagrammatic view schematically showing a construction of part of the acoustic cooling system shown in FIG. 9. Referring to FIGS. 9 and 10, the acoustic cooling system 100 shown includes an acoustic compressor 110, a condenser 120, a carburetor 130, an oscillation circuit 140 and a control circuit 180. The acoustic compressor 110 and the condenser 120 are connected to each other by a discharge pipe 150, and the acoustic compressor 110 and the carburetor 130 are connected to each other by a suction pipe 160. Further, an exit 121 of the condenser 120 and an entrance 131 of the carburetor 130 are connected to each other by a capillary tube 170.

The acoustic compressor 110 compresses desired coolant such as, for example, freon gas for cooling a cooling object such as, for example, air in a refrigerator making use of a sound wave (acoustic oscillatory wave). The acoustic compressor 110 includes, as seen in FIG. 10, a tubular chamber (vessel) 111 in which the coolant is contained, and an acoustic driver (sound source) 112 provided adjacent an opening 115 of the chamber 111 for forwarding a sound wave into the chamber 111. The acoustic driver 112 is driven with a predetermined frequency by the oscillation circuit 140 so that it forwards a sound wave of a predetermined wavelength into the chamber 111 to produce an acoustic standing wave in the chamber 111 to compress the coolant.

The acoustic driver 112 is controlled by the control circuit 180 so that the sound pressure of a sound wave to be forwarded may be optimized to keep the temperature and the pressure of the coolant at respective predetermined optimum values. The function just described is realized, for example, by supervising the temperature and the pressure of the coolant which is in the chamber 111 or which passes through a pipe which forms the condenser 120 using temperature and pressure sensors or like devices.

The chamber 111 has a length L set to $3\lambda/4$ (where $\lambda$ is the wavelength of a sound wave forwarded from the acoustic driver 112) so that one pressure node 117 and one pressure antinode 118 of a standing wave may be produced in the chamber 111 as seen in FIG. 10.

The chamber 111 has a discharge chamber 113 and a suction chamber 114 provided at locations on a curved face thereof which correspond to the positions at which the pressure node 117 and the pressure antinode 118 are produced. The discharge chamber 113 is provided for communication with the chamber 111 through a discharge valve 113*a*, and the suction chamber 114 is provided for communication with the chamber 111 through a suction valve 114*a*.

If the pressure around the pressure node 117 becomes higher than a predetermined value, then the discharge valve 113*a* is opened to allow the compressed coolant to be discharged into the discharge pipe 150 through the discharge chamber 113. When the pressure around the pressure antinode 118 becomes lower than a predetermined value as a result of the discharging operation, the suction valve 114*a* is opened to allow the coolant, which has circulated through the condenser 120 and the carburetor 130, to be sucked into the chamber 111 through the suction chamber 114.

The condenser 120 radiates heat of the coolant, which is compressed by the acoustic compressor 110 and flows as gas of a high temperature and a high pressure into the condenser 120 through the discharge pipe 150, to the outside to condense the coolant into coolant of a room temperature and a high pressure in the form of liquid. The capillary tube 170 reduces the pressure of the coolant of a room temperature and a high pressure in the form of liquid by the flow resistance thereof. If the pressure of the liquid coolant is reduced lower than a certain fixed value by the flow resistance, then the liquid coolant begins to partially vaporize (evaporate) and enter into a low temperature, low pressure state.

The carburetor 130 fully vaporizes (expands) the liquid coolant, which has begun to partially vaporize and flows into the carburetor 130 through the capillary tube 170, into high temperature, high pressure gas, whereupon the carburetor 130 derives heat necessary for such vaporization from a cooling object such as, for example, air in a cooling space 132 of the refrigerator to cool the cooling object. It is to be noted that the coolant (gas) of a high temperature and a low pressure which has derived heat from the cooling object in this manner is sucked into the acoustic compressor 110 through the suction pipe 160 and the suction chamber 114 and compressed again by the acoustic compressor 110, and consequently, it is discharged as high temperature, high pressure coolant into the condenser 120 through the discharge pipe 150.

In the typical acoustic cooling system 100 having such a construction as described above, when the acoustic driver 112 is driven by the oscillation circuit 140 first, a sound wave having, for example, a wavelength $\lambda$ is forwarded into the chamber 111. Consequently, the sound wave (progressive wave) is reflected in a condition displaced by 180 degrees in phase by a face of an end wall 116 of the chamber 111. Since the length L of the chamber 111 is $3\lambda/4$, the reflected wave resonates with the progressive wave from the acoustic driver 112 to form an acoustic standing wave which has a pressure node 117 and a pressure antinode 118.

In this condition, if the control circuit 180 controls the sound pressure of the sound wave to be forwarded from the acoustic driver 112 so that the pressure around the pressure node 117 may be higher than the predetermined value, then the discharge valve 113*a* is opened. Consequently, the compressed coolant (gas) of a high temperature and a high voltage is discharged into the discharge pipe 150 through the discharge chamber 113. The coolant is then forwarded into the condenser 120 through the discharge pipe 150, and in the condenser 120, the coolant discharges its heat to the outside (into the air). Consequently, the coolant changes into coolant of a low temperature and a high pressure in the form of liquid.

Then, the liquid coolant is forwarded into the carburetor 130 through the capillary tube 170. When the liquid coolant passes the capillary tube 170, the pressure thereof is reduced by the flow resistance of the capillary tube 170 and the liquid coolant partially begins to vaporize (becomes coolant of a low temperature and a low pressure). When the liquid coolant which has begun to partially vaporize flows into the carburetor 130 from the capillary tube 170, it derives heat from the cooling object (air) in the cooling space 132, whereupon it is vaporized fully (becomes coolant of a high temperature and a low pressure).

The coolant which has derived heat from the cooling object in this manner is forwarded into the suction chamber 114 of the acoustic compressor 110 through the suction pipe 160. Then, the coolant is sucked into the chamber 111 from the suction chamber 114 as the suction valve 114*a* is opened when compressed coolant is discharged through the discharge chamber 113 until the pressure around the pressure antinode 118 in the chamber 111 becomes lower than the predetermined value. The coolant is compressed in the chamber 111 again and forwarded into the discharge pipe 150.

In this manner, the acoustic cooling system 100 repeats the compression-vaporization cycle of the coolant to cool the cooling object efficiently. In particular, the acoustic cooling system 100 described above causes an acoustic standing wave to be produced in the chamber 111 by a sound wave forwarded from the acoustic driver 112 and cools the cooling object making use of the endothermic action of the coolant when the coolant is vaporized (expanded) by the carburetor 130.

However, the acoustic cooling system 100 having such a construction as described above is very noisy since no countermeasure is taken against noise which is produced when the acoustic driver 112 in the acoustic compressor 110 is driven and vibrates. Particularly when the coolant is compressed, since the output power of the acoustic driver 112 is raised to raise the sound pressure of the sound wave to be forwarded, very high noise is produced.

SUMMARY OF THE INVENTION

It is an object of the present invention to provide an acoustic cooling system with a noise reduction function which can effectively reduce noise produced from a sound source used in the acoustic cooling system.

In order to attain the object described above, according to the present invention, an acoustic cooling system with a noise reduction function forwards cancellation sound having a characteristic capable of cancelling or offsetting noise originating from a sound source used in the acoustic cooling system into the sound source.

More particularly, according to an aspect of the present invention, there is provided an acoustic cooling system with a noise reduction function which includes a vessel in which coolant for cooling a cooling object is contained, a sound source for forwarding a sound wave into the inside of the vessel, and a sound source control element for producing a driving control signal for driving the sound source and outputting the driving control signal to the sound source and wherein the sound source control element controls a driving condition of the sound source to compress the coolant by the sound wave and the cooling object is cooled making use of an endothermic action of the coolant when the compressed coolant is expanded, the acoustic cooling system comprising a cancellation signal production element for producing, in accordance with the driving control signal produced by the sound source control element, a cancellation signal having a characteristic capable of cancelling noise which is produced as the sound source is driven, a cancellation signal level adjustment element for adjusting a signal level of the cancellation signal produced by the cancellation signal production element in accordance with the driving control signal produced by the sound source control element, and a cancellation sound outputting element for converting the cancellation signal produced by the cancellation signal production element and having the signal level adjusted by the cancellation signal level adjustment element into a sound wave and outputting the sound wave as cancellation sound for the noise.

With the acoustic cooling system with a noise reduction function, even if the driving condition of the sound source for compressing the coolant is changed by the driving control signal from the sound source control element, since the signal level of the cancellation signal produced to cancel the driving noise of the sound source is adjusted in accordance with the driving control signal, in whatever manner the driving condition of the sound source changes, the cancellation sound can be produced and outputted with an optimum level following up the change rapidly. Consequently, the driving noise of the sound source can be reduced very efficiently irrespective of the driving condition of the sound source.

According to another aspect of the present invention, there is provided an acoustic cooling system with a noise reduction function which includes a vessel in which coolant for cooling a cooling object is contained, a sound source for forwarding a sound wave into the inside of the vessel, and a sound source control element for producing a driving control signal for driving the sound source and outputting the driving control signal to the sound source and wherein the sound source control element controls a driving condition of the sound source to compress the coolant by the sound wave and the cooling object is cooled making use of an endothermic action of the coolant when the compressed coolant is expanded, the acoustic cooling system comprising a noise detection element for detecting noise produced as the sound source is driven as a noise signal, a cancellation signal production element for producing a cancellation signal having a characteristic capable of cancelling the noise based on the noise signal detected by the noise detection element, a cancellation signal level adjustment element for adjusting a signal level of the cancellation signal produced by the cancellation signal production element in accordance with the driving control signal produced by the sound source control element, and a cancellation sound outputting element for converting the cancellation signal produced by the cancellation signal production element and having the signal level adjusted by the cancellation signal level adjustment element into a sound wave and outputting the sound wave as cancellation sound for the noise.

With the acoustic cooling system with a noise reduction function, when cancellation sound of an optimum level is to be produced and outputted taking the driving condition of the sound source into consideration, since cancellation sound can be produced based on actual noise which is actually produced and detected when the sound source is driven, cancellation sound having a characteristic more suitable to cancel the actual noise can be produced, and consequently, the driving noise of the sound source can be reduced more efficiently and with a higher degree of accuracy.

Further objects, features and advantages of the present invention will become apparent from the following detailed description when read in conjunction with the accompanying drawings in which like parts or elements are denoted by like reference characters.

DESCRIPTION OF THE PREFERRED EMBODIMENTS a. Aspects of the Invention

First, different aspects of the present invention are described with reference to the accompanying drawings.

Figure 1:
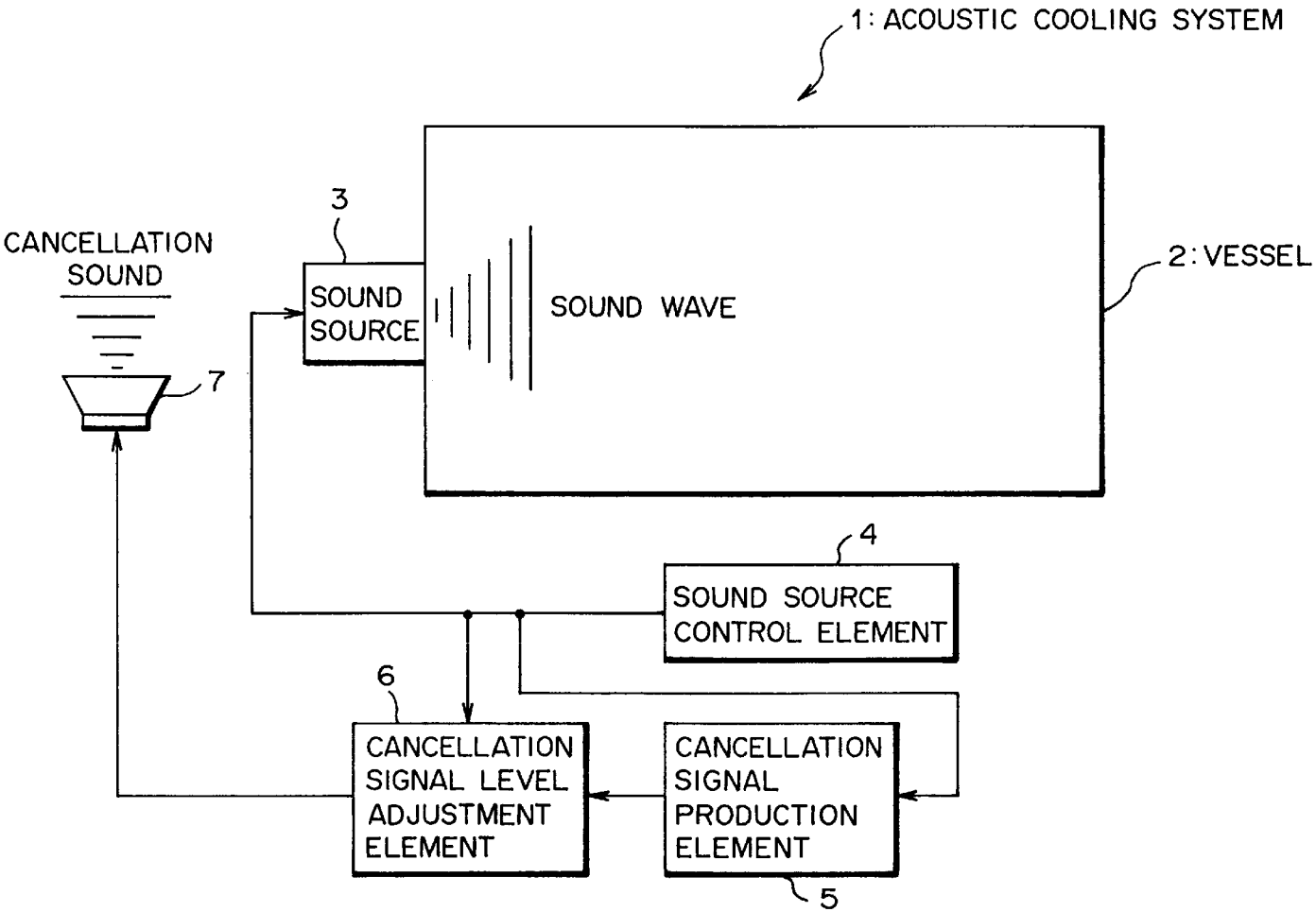
FIGS. 1 and 2 are block diagrams illustrating different aspects of the present invention.

FIG. 1 is a block diagram showing an acoustic cooling system with a noise reduction function according to an aspect of the present invention. Referring to FIG. 1, the acoustic cooling system 1 shown includes a vessel 2 in which coolant for cooling a cooling object is contained, a sound source 3 for forwarding a sound wave into the inside of the vessel 2, and a sound source control element 4 for producing a driving control signal for driving the sound source 3 and outputting the driving control signal to the sound source 3. In the acoustic cooling system 1, the sound source control element 4 controls a driving condition of the sound source 3 to compress the coolant in the vessel 2 by the sound wave and the cooling object is cooled making use of an endothermic action of the coolant when the compressed coolant is expanded.

According to the first aspect of the present invention, as seen from FIG. 1, the acoustic cooling system 1 includes, in addition to the components mentioned above, a cancellation signal production element 5, a cancellation signal level adjustment element 6 and a cancellation sound outputting element 7.

The cancellation signal production element 5 produces, in accordance with the driving control signal produced by the sound source control element 4, a cancellation signal having a characteristic capable of cancelling noise which is produced as the sound source 3 is driven. The cancellation signal level adjustment element 6 adjusts the signal level of the cancellation signal produced by the cancellation signal production element 5 in accordance with the driving control signal produced by the sound source control element 4. The cancellation sound outputting element 7 converts the cancellation signal produced by the cancellation signal production element 5 and having the signal level adjusted by the cancellation signal level adjustment element 6 into a sound wave and outputs the sound wave as cancellation sound for the noise.

In the acoustic cooling system 1 with a noise reduction function of the first aspect of the present invention having the construction described above, when the sound source 3 is driven by the sound source control element 4, the cancellation signal production element 5 produces, in accordance with a driving control signal which is provided to the sound source 3 then, a cancellation signal having a characteristic capable of cancelling noise which is produced as the sound source 3 is driven. Then, the signal level of the cancellation signal is adjusted by the cancellation signal level adjustment element 6 in accordance with the driving control signal, and the resulting signal is supplied to the cancellation sound outputting element 7, by and from which it is converted into a sound wave and outputted as cancellation sound for the noise.

Consequently, with the acoustic cooling system 1 with a noise reduction function of the first aspect of the present invention (hereinafter referred to simply as "acoustic cooling system"), even if the driving condition of the sound source 3 is changed by the driving control signal from the sound source control element 4, cancellation sound of an optimum level taking the driving condition into consideration can be produced and outputted following up the change rapidly. Accordingly, the driving noise of the sound source 3 can be reduced very efficiently irrespective of the driving condition of the sound source 3.

The acoustic cooling system 1 may be constructed such that it further includes a remaining noise detection element for detecting remaining noise which originates from the noise (which may be referred to as driving noise) produced as the sound source 3 is driven and remains without being cancelled by the cancellation sound as a remaining noise signal, and the cancellation signal production element 5 includes an adaptive control element for adaptively controlling production of the cancellation signal so that the remaining noise signal detected by the remaining noise detection element may be minimized.

With the acoustic cooling system 1 having the construction just described, if a remaining noise signal is detected by the remaining noise detection element, then the adaptive control element adaptively controls production of the cancellation signal so that the remaining noise signal may be minimized. Consequently, in whatever manner the characteristic of the driving noise changes, that is, even if the characteristic of the driving noise of the sound source 3 suddenly exhibits a large change, the acoustic cooling system 1 can follow up the change to always minimize the driving noise. Consequently, the noise reduction capability can be improved remarkably.

The acoustic cooling system 1 may further include a remaining noise signal level adjustment element for adjusting a signal level of the remaining noise signal to be inputted to the adaptive control element in accordance with the driving control signal produced by the sound source control element 4.

With the acoustic cooling system 1 having the construction just described, since the signal level of the remaining noise signal to be used for adaptive control upon production of a cancellation signal is automatically adjusted in response to the driving condition of the sound source 3 indicated by the driving control signal, in whatever manner the driving condition of the sound source 3 changes, the acoustic cooling system 1 can follow up the change and adjust the signal level of the remaining noise signal always to an optimum level. Accordingly, adaptive control upon production of a cancellation signal can be stabilized, and the reliability of the noise reduction function can be improved significantly.

The adaptive control element described above may include, for example, an adaptive filter for simulating a noise transmission system when the noise produced as the sound source 3 is driven is transmitted to the cancellation sound outputting element 7 in accordance with the driving control signal produced by the sound source control element 4 to produce the cancellation signal, and a simulation processing control element for controlling the simulation processing of the noise transmission system by the adaptive filter in response to the remaining noise signal detected by the remaining noise detection element.

With the acoustic cooling system 1 having the construction just described, since the adaptive control element simulates the noise transmission system when the driving noise is transmitted to the cancellation sound outputting element 7 in accordance with the driving control signal, with which the sound source 3 is driven, taking the remaining noise signal detected by the remaining noise detection element into consideration to produce the cancellation signal to be used for cancellation of the driving noise, even if the sound transmission system changes and remaining noise is produced, the acoustic cooling system 1 can follow up the change to produce a cancellation signal having an optimum noise cancellation characteristic to the noise transmission system after the change. Consequently, the noise reduction capability can be further improved.

Here, the adaptive filter may be constructed such that it simulates the noise transmission system to produce the cancellation signal, for example, by multiplying a plurality of signals obtained by delaying the driving control signal by respective predetermined coefficients and adding the signals obtained by the multiplication. In this instance, the simulation processing control element is constructed such that it adjusts the coefficients of the adaptive filter in response to the remaining noise signal detected by the remaining noise detection element to control the simulation processing of the noise transmission system.

With the acoustic cooling system 1 having the construction just described, the adaptive filter can be formed using hardware such as a delay element, a multiplier and an adder. Further, since the simulation processing control element can simulate the noise transmission system, which changes every time, with fidelity and on the real time basis only by adjusting the coefficients of the adaptive filter in response to the remaining noise signal, the driving noise of the sound source 3 can be reduced with a very high degree of accuracy.

Figure 2:
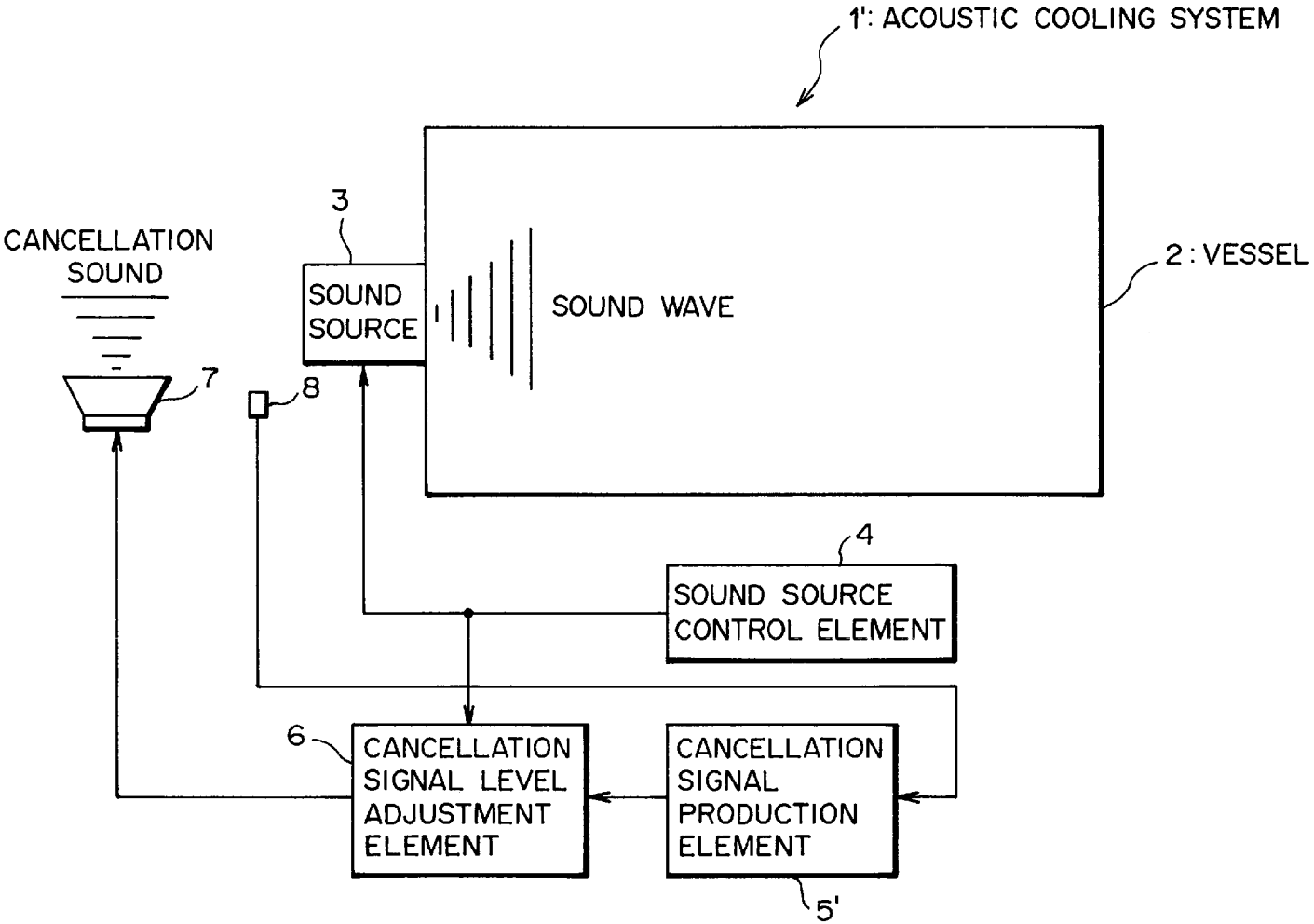

Referring now to FIG. 2, there is shown an acoustic cooling system according to another aspect of the present invention. Also the acoustic cooling system 1' shown includes a vessel 2, a sound source 3 and a sound source control element 4, which are basically similar to those described hereinabove with reference to FIG. 1, and is constructed such that the sound source control element 4 controls a driving condition of the sound source 3 to compress coolant in the vessel 2 by a sound wave and the cooling object is cooled making use of an endothermic action of the coolant when the compressed coolant is expanded. However, the present acoustic cooling system 1' further includes, in addition to a cancellation signal level adjustment element 6 and a cancellation sound outputting element 7 described hereinabove with reference to FIG. 1, a noise detection element 8 and a cancellation signal production element 5'.

The noise detection element 8 detects noise produced as the sound source 3 is driven as a noise signal. The cancellation signal production element 5' produces a cancellation signal having a characteristic capable of cancelling the noise based on the noise signal detected by the noise detection element 8. Thus, the acoustic cooling system 1' shown in FIG. 2 does not produce a cancellation signal based on the driving control signal as in the acoustic cooling system 1' shown in FIG. 1, but produces a cancellation signal based on noise being actually produced by the sound source and detected by the noise detection element 8.

Consequently, also the acoustic cooling system 1' can produce and output cancellation sound of an optimum level taking the driving condition of the sound source 3 into consideration in a similar manner as in the acoustic cooling system 1 shown in FIG. 1. In this instance, however, since the cancellation signal is produced based on actually produced noise detected by the noise detection element 8, cancellation noise having a characteristic more suitable for cancellation of actual noise can be outputted. Accordingly, the driving noise of the sound source 3 can be reduced more effectively and with a higher degree of accuracy.

The acoustic cooling system 1' may further include a noise signal level adjustment element for adjusting a signal level of the noise signal to be inputted to the cancellation signal production element 5' in accordance with the driving control signal produced by the sound source control element 4.

With the acoustic cooling system 1' having the construction just described, since the signal level of the noise signal detected by the noise detection element 8 to be used for production of a cancellation signal is adjusted in response to the driving condition of the sound source 3 indicated by the driving control signal, in whatever manner the driving condition of the sound source 3 changes, the acoustic cooling system 1' can follow up the change to automatically adjust the signal level of the noise signal always to an optimum level. Consequently, production of a cancellation signal can be stabilized, and this contributes very much to improvement in reliability of the noise reduction function.

Further, the acoustic cooling system 1' may be constructed such that, similarly to the acoustic cooling system 1 described hereinabove with reference to FIG. 1, it further includes a remaining noise detection element for detecting remaining noise which originates from the noise produced as the sound source 3 is driven and remains without being cancelled by the cancellation sound as a remaining noise signal, and the cancellation signal production element 5' includes an adaptive control element for adaptively controlling production of the cancellation signal so that the remaining noise signal detected by the remaining noise detection element may be minimized.

Also with the acoustic cooling system 1' having the construction just described, if a remaining noise signal is detected by the remaining noise detection element, then the adaptive control element adaptively controls production of the cancellation signal so that the remaining noise signal may be minimized. Consequently, in whatever manner the characteristic of the driving noise changes, that is, even if the characteristic of the driving noise of the sound source 3 suddenly exhibits a large change, the acoustic cooling system 1' can follow up the change to always minimize the driving noise. Consequently, also in this instance, the noise reduction capability can be improved remarkably.

Further, if the acoustic cooling system 1' further includes a remaining noise signal level adjustment element for adjusting a signal level of the remaining noise signal to be inputted to the adaptive control element in accordance with the driving control signal produced by the sound source control element 4, then since the signal level of the remaining noise signal to be used for adaptive control upon production of a cancellation signal is automatically adjusted, the signal level of the remaining noise signal can always be adjusted to an optimum level irrespective of the driving condition of the sound source 3. Accordingly, adaptive control upon production of a cancellation signal can be stabilized, and this further contributes to improvement in reliability of the noise reduction function.

In this instance, the adaptive control element may include, for example, an adaptive filter for simulating a noise transmission system when the noise produced as the sound source 3 is driven is transmitted to the cancellation sound outputting element 7 in accordance with the noise signal detected by the noise detection element 8 to produce the cancellation signal, and a simulation processing control element for controlling the simulation processing of the noise transmission system by the adaptive filter in response to the remaining noise signal detected by the remaining noise detection element.

Since the adaptive control element having the construction described above simulates the noise transmission system when the driving noise of the sound source 3 is transmitted to the cancellation sound outputting element 7 in accordance with the noise signal detected by the noise detection element 8 taking the remaining noise signal into consideration to produce the cancellation signal to be used for cancellation of the driving noise, the change of the noise transmission system can be followed up to produce a cancellation signal having an optimum noise cancellation characteristic. Further, in this instance, the noise transmission system can be simulated with a higher degree of fidelity based on the noise being actually produced and detected by the noise detection element 8. Consequently, the driving noise of the sound source 3 can be reduced further effectively.

Further, in this instance, the adaptive filter may be constructed such that it simulates the noise transmission system to produce the cancellation signal by multiplying a plurality of signals obtained by delaying the noise signal by respective predetermined coefficients and adding the signals obtained by the multiplication, and the simulation processing control element may be constructed such that it adjusts the coefficients of the adaptive filter in response to the remaining noise signal detected by the remaining noise detection element to control the simulation processing of the noise transmission system.

With the acoustic cooling system 1' having the construction described above, also the adaptive filter can be formed using hardware such as a delay element, a multiplier and an adder. Further, since also the simulation processing control element can simulate the noise transmission system, which changes every time, with fidelity and on the real time basis only by adjusting the coefficients of the adaptive filter in response to the remaining noise signal, the driving noise of the sound source 3 can be reduced with a very high degree of accuracy.

The adaptive control element may include a simulation noise signal production element for simulating a noise transmission system when the cancellation sound outputted from the cancellation sound outputting element 7 is transmitted to the noise detection element 8 based on the cancellation signal to produce a simulation noise signal, an adaptive filter for simulating the noise transmission system based on a difference signal between the noise signal detected by the noise detection element 8 and the simulation noise signal produced by the simulation noise signal production element to produce the cancellation signal, and a simulation processing control element for controlling the simulation processing of the noise transmission system by the adaptive filter in response to the remaining noise signal detected by the remaining noise detection element.

In the adaptive control element having the construction just described, since the simulation noise signal production element simulates a noise transmission system when cancellation sound to be used for cancellation of the driving noise of the sound source 3 is detected as noise by the noise detection element 8 and the adaptive filter simulates the noise transmission system after the noise provided by the cancellation sound is subtracted from the noise signal detected by the noise detection element 8, the noise transmission system can be simulated with fidelity to produce and output cancellation sound while suppressing the influence of the cancellation sound upon the noise detection element 8 to the minimum. Consequently, the noise reduction accuracy can be improved significantly.

Further, the adaptive filter may be constructed such that it simulates the noise transmission system to produce the cancellation signal by multiplying a plurality of signals obtained by delaying the difference signal by respective predetermined coefficients and adding the signals obtained by the multiplication, and the simulation processing control element may be constructed such that it adjusts the coefficients of the adaptive filter in response to the remaining noise signal detected by the remaining noise detection element to control the simulation processing of the noise transmission system.

With the acoustic cooling system 1' having the construction just described, also the adaptive filter can be formed using hardware such as a delay element, a multiplier and an adder. Further, since also the simulation processing control element can simulate the noise transmission system, which changes every time, with fidelity and on the real time basis only by adjusting the coefficients of the adaptive filter in response to the remaining noise signal, the driving noise of the sound source 3 can be reduced with a very high degree of accuracy.

Further, if the simulation noise signal production element is constructed such that it produces the simulation noise signal by multiplying a plurality of signals obtained by delaying the cancellation signal by respective predetermined coefficients and adding the signals obtained by the multiplication, then also the simulation noise signal production element can be formed using hardware such as a delay element, a multiplier and an adder. Consequently, also the simulation noise signal can be produced at a higher speed.

b. Embodiments of the Invention

In the following, different preferred embodiments are described with reference to the accompanying drawings.

b-1. First Embodiment

Figure 3:
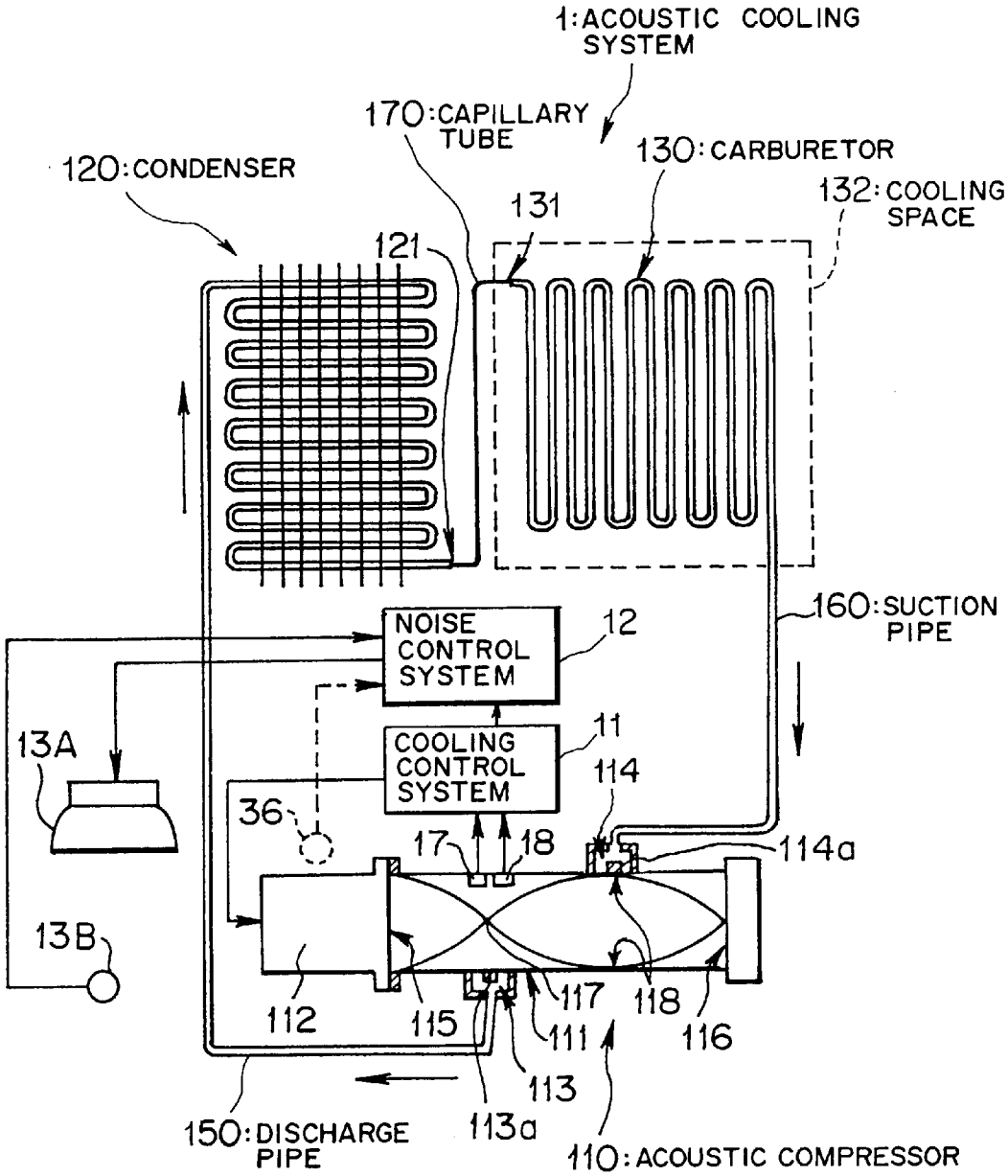
FIG. 3 is a diagrammatic view schematically showing a construction of an acoustic cooling system with a noise reduction function according to a first preferred embodiment of the present invention.

FIG. 3 schematically shows a construction of an acoustic cooling system with a noise reduction function according to a first preferred embodiment of the present invention. Referring to FIG. 3, the acoustic cooling system with a noise reduction function (which may be hereinafter referred to simply as "acoustic cooling system) shown is generally denoted at 1 and includes an acoustic compressor 110, a condenser 120 and a carburetor 130 which are similar to those described hereinabove with reference to FIG. 10. The acoustic cooling system 1 further includes a cooling control system 11, a noise control system 12, a speaker (actuator) 13A and an error microphone 13B.

Figure 10:
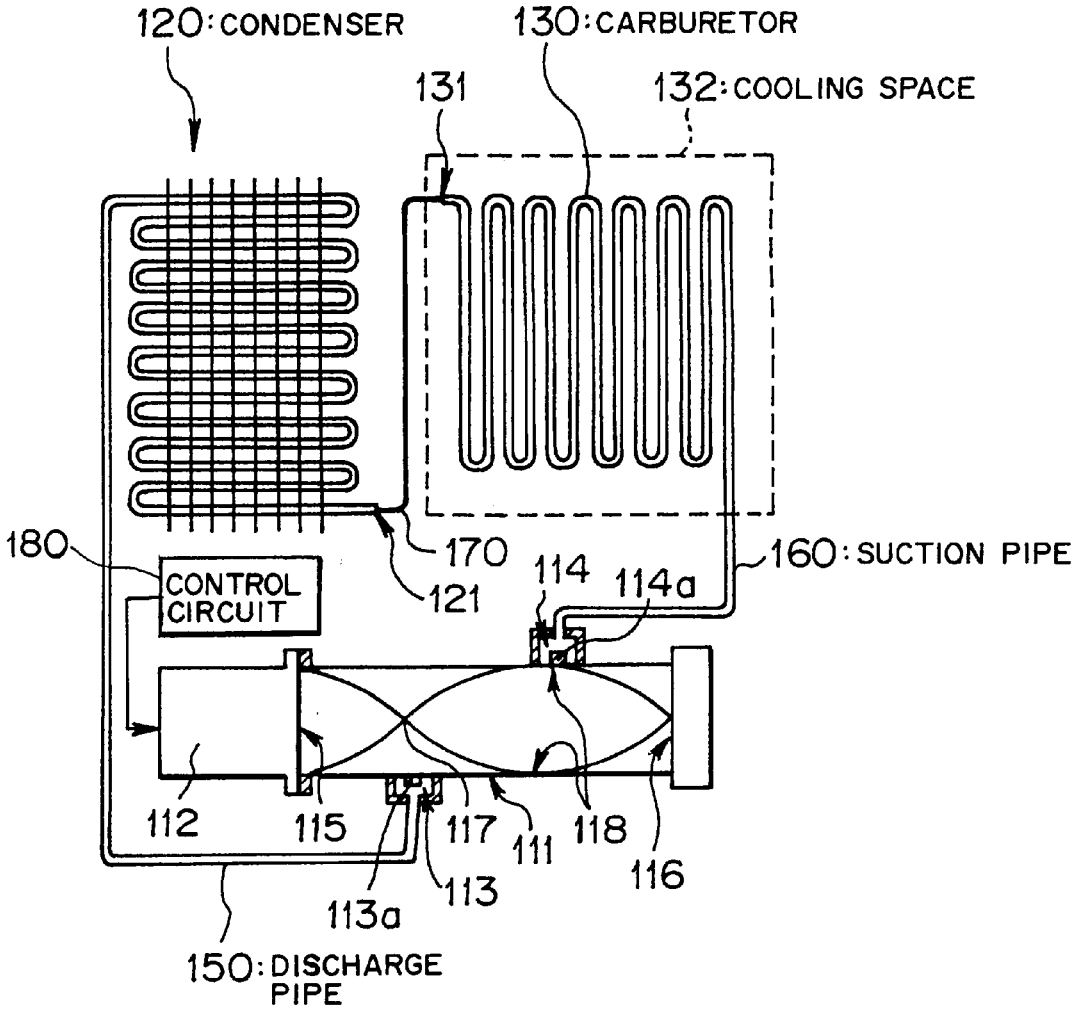
FIG. 10 RELATED ART
FIG. 10 is a diagrammatic view schematically showing a construction of part of the acoustic cooling system of FIG. 9.

It is to be noted that, in FIG. 3, like reference symbols to those in FIG. 10 denote like elements, and also in the acoustic cooling system 1, similarly as in the acoustic cooling system of FIG. 10, a cooling object in a cooling space 132 is cooled by a compression-vaporization cycle of coolant such as, for example, freon gas by the acoustic compressor 110, condenser 120 and carburetor 130. It is to be noted that an element denoted at 36 in FIG. 3 is hereinafter described in connection with a second preferred embodiment of the present invention.

The cooling control system (sound source control section) 11 controls driving of an acoustic driver (sound source) 112 of the acoustic compressor 110 to control compression and discharging of the coolant in a chamber 111 and suction of the coolant into the chamber 111. More particularly, in the present embodiment, the cooling control system 11 supervises the pressure and the temperature of the coolant using a pressure sensor 17 and a temperature sensor 18 provided in the chamber 111 and optically controls the acoustic driver 112 so that the pressure and the temperature may have individual predetermined values.

The cooling control system (sound source control section) 11 control driving of an acoustic driver (sound source) 112 of the acoustic compressor 110 to control compression and discharging of the coolant in a chamber 111 and suction of the coolant into the chamber 111. More particularly, in the present embodiment, the cooling control system 11 supervise the pressure and the temperature of the coolant using a pressure sensor 17 and a temperature sensor 18 provided in the chamber 111 and optimally controls the acoustic driver 112 so that the pressure and the temperature may have individual predetermined values.

The speaker (cancellation sound outputting section) 13A converts the cancellation signal produced by the noise control system 12 into a sound wave and outputs the sound wave as cancellation sound for the driving noise of the acoustic driver 112. However, the noise control system 12 in the present embodiment adjusts the signal level of the cancellation signal mentioned above in accordance with the driving control signal as hereinafter described. Therefore, the speaker 13A converts the cancellation signal, whose signal level has been adjusted in this manner, into and outputs cancellation sound.

The error microphone (remaining noise detection section) 13B detects remaining noise which originates from the driving sound of the acoustic driver 112 and has not been cancelled by cancellation sound outputted from the speaker 13A as a remaining noise signal (which may be suitably referred to as error signal). More particularly, in the present embodiment, production of a cancellation signal by the noise control system 12 is adaptively controlled so that the remaining noise signal detected by the error microphone 13B may be zero (minimized) as hereinafter described.

Figure 4:
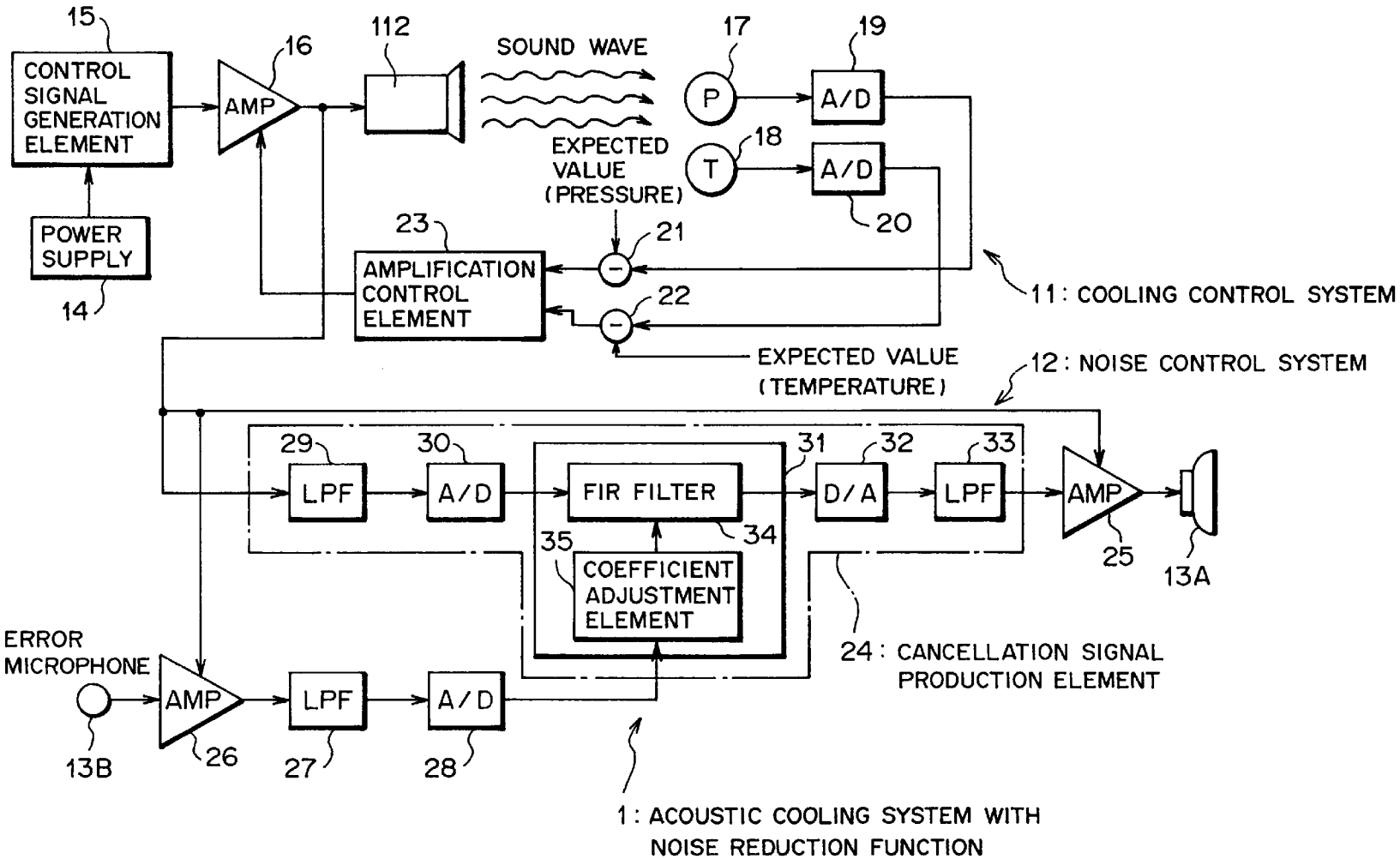
FIG. 4 is a block diagram showing a detailed construction of part of the acoustic cooling system with a noise reduction function of FIG. 3.

In particular, the cooling control system 11 includes, for example, as seen in FIG. 4, in addition to the acoustic driver 112, pressure sensor 17 and temperature sensor 18 described above, a power supply 14, a control signal generation element 15, an amplifier (AMP) 16, a pair of analog to digital (A/D) converters 19 and 20, a pair of subtractors 21 and 22, and an amplification control element 23. Meanwhile, the noise control system 12 includes, as seen in FIG. 4, a cancellation signal production element 24, a pair of amplifiers (AMP) 25 and 26, a low-pass filter (LPF) 27, and an A/D converter 28.

Here, first in the cooling control system 11, the power supply 14 supplies power for the acoustic cooling system 1. The control signal generation element 15 generates a signal (driving control signal) of a predetermined frequency for driving the acoustic driver 112 with the power supplied thereto from the power, supply 14. The amplifier 16 amplifies the driving control signal generated by the control signal generation element 15. In the present embodiment, an amplifier of the variable amplification factor type is used for the amplifier 16, and the amplification factor of the amplifier 16 is controlled by the amplification control element 23 to adjust the output level of the driving control signal.

The A/D converters 19 and 20 convert pressure information and temperature information of the coolant detected by the pressure sensor 17 and the temperature sensor 18 into digital signals, respectively. The subtractors 21 and 22 calculate differences between the pressure information and temperature information detected by the pressure sensor 17 and temperature sensor 18 and expected values (expected pressure information and expected temperature information) for them, respectively.

The amplification control element 23 controls the amplification factor of the amplifier 16 in response to the difference information of the pressure and temperature of the coolant obtained by the subtractors 21 and 22 from the respective expected values to control the output level of the driving control signal to the acoustic driver 112 to thereby optimally control the sound pressure of a sound wave [the volume (driving condition) of the acoustic driver 112] to be forwarded from the acoustic driver 112 so that the pressure and the temperature of the coolant may be the respective predetermined values.

Meanwhile in the noise control system 12, the cancellation signal production element 24 produces, as such a cancellation signal as described above, based on the driving control signal to the acoustic driver 112 produced by the cooling control system 11 (control signal generation element 15) described above, an opposite phase signal which has a signal waveform of the opposite phase to that of the signal waveform of the driving noise and can thus cancel and erase the driving noise of the acoustic driver 112. In the present embodiment, the noise control system 12 optimally controls production of the cancellation signal in response to an error signal detected by the error microphone 13B as hereinafter described.

The amplifier 25 amplifies the opposite phase signal produced by the cancellation signal production element 24. For the amplifier 25, an amplifier of the variable amplification factor type similar to that of the amplifier 16 described above is employed, and the amplification factor of the amplifier 25 is controlled in response to the level of the driving control signal to the acoustic driver 112 to control the signal level of the opposite phase signal. In other words, the amplifier 25 has a function as a cancellation signal level adjustment element for adjusting the signal level of the opposite phase signal produced by the cancellation signal production element 24 in accordance with the driving control signal to the acoustic driver 112 produced by the cooling control system 11.

The amplifier 26 amplifies the error signal detected by the error microphone 13B. Also for the amplifier 26, an amplifier of the variable amplification factor type similar to that of the amplifier 25 described above is employed, and the amplification factor of the amplifier 26 is controlled in accordance with the driving control signal to the acoustic driver 112 to control the signal level of the error signal. In other words, the amplifier 26 has a function as a remaining noise signal level adjustment element for adjusting the signal level of the error signal to be inputted to an adaptive control element 31, which will be hereinafter described, in accordance with the driving control signal.

The low-pass filter 27 filters the error signal inputted thereto through the amplifier 26 so that it passes only signals of a frequency band lower than a particular frequency (for example, a frequency of sound which sounds harsh or disagreeable as noise to the ear of a human being) and removes signals of an unnecessary frequency band such as noise components. The A/D converter 28 converts the error signal, which has passed through the low-pass filter 27, into a digital signal.

The cancellation signal production element 24 mentioned above includes, in order to achieve such a function as described hereinabove, two low-pass filters 29 and 33, an A/D converter 30, an adaptive control element 31 and a digital/analog (D/A) converter 32.

The low-pass filter 29 filters the driving control signal to the acoustic driver 112 to remove unnecessary signals from the driving control signal while passing only signals of a frequency band lower than the particular frequency therethrough in a similar manner to that of the low-pass filter 27 described above. The A/D converter 30 converts the driving control signal, which has passed through the low-pass filter 29, into a digital signal.

The adaptive control element 31 adaptively controls production of the cancellation signal so that the error signal detected by the error microphone 13B may be reduced to zero (minimized). In the present embodiment, as seen in FIG. 4, the adaptive control element 31 includes a non-cyclic digital filter [FIR (Finite Impulse Response) filter] 34, and a coefficient adjustment element 35.

Figure 5:
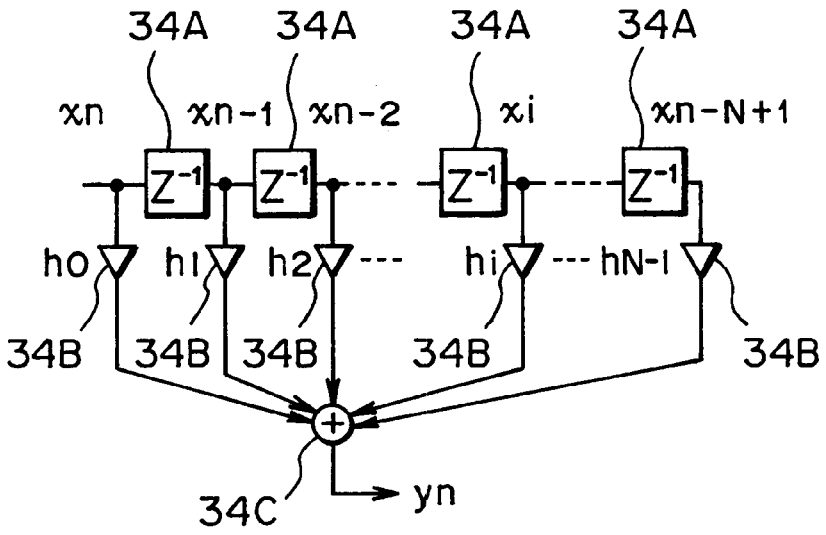
FIG. 5 is a block diagram showing a construction of an FIR filter employed in the acoustic cooling system with a noise reduction function of FIG. 3.

The FIR filter (adaptive filter) 34 simulates a noise transmission system when the driving noise of the acoustic driver 112 is transmitted to the speaker 13A in accordance with the driving control signal to the acoustic driver 112 to produce a cancellation signal described above which has a signal waveform opposite in phase to the signal waveform of the driving noise. In the present embodiment, the FIR filter (adaptive filter) 34 includes, for example, as seen in FIG. 5, a plurality of delay elements 34A, a plurality of multipliers 34B and a single adder 34C.

The delay elements 34A delay the driving control signal ($X_n$: n is a natural number) to the acoustic driver 112 produced by the cooling control system 11. The multipliers 34B multiply a plurality of signals ($X_n$, $X_{n-1}$, . . . , $X_{n-N+1}$: N is a natural number) obtained by delaying the driving control signal by the delay elements 34A by respective predetermined weight coefficients (tap coefficients: $h_0$, $h_1$, . . . , $h_{N-1}$). The adder 34C adds signals obtained by the multipliers 34B to produce a cancellation signal ($y_n$) described above.

In short, the FIR filter 34 multiplies a plurality of signals ($X_n$, $X_{n-1}$, . . . , $X_{n-N+1}$) obtained by delaying the driving control signal to the acoustic driver 112 by the respective predetermined tap coefficients ($h_0$, $h_1$, . . . , $h_{N-1}$) and adds the resulting signals (convolutes the driving control signal) to simulate the noise transmission system mentioned above to produce the cancellation signal ($y_n$).

Referring back to FIG. 4, the coefficient adjustment element (simulation processing control section) 35 adjusts the tap coefficients ($h_0$, $h_1$, . . . , $h_{N-1}$) of the FIR filter 34 in response to the error signal detected by the error microphone 13B and inputted thereto through the amplifier 26, low-pass filter 27 and A/D converter 28 to control the simulation processing (production of a cancellation signal) of the noise transmission system so that the error signal may be reduced to zero.

The D/A converter 32 converts the cancellation signal produced by the FIR filter 34 into an analog signal. The low-pass filter 33 filters the cancellation signal after conversion into an analog signal by the D/A converter 32 to remove unnecessary signals while passing only signals of a frequency band lower than the predetermined frequency therethrough.

Further, though not shown in FIG. 4, the subtractors 21 and 22 and the amplification control element 23 of the cooling control system 11 and the adaptive control element 31 of the noise control system 12 are formed (as firmware) from a single DSP (digital signal processor).

Figure 6:
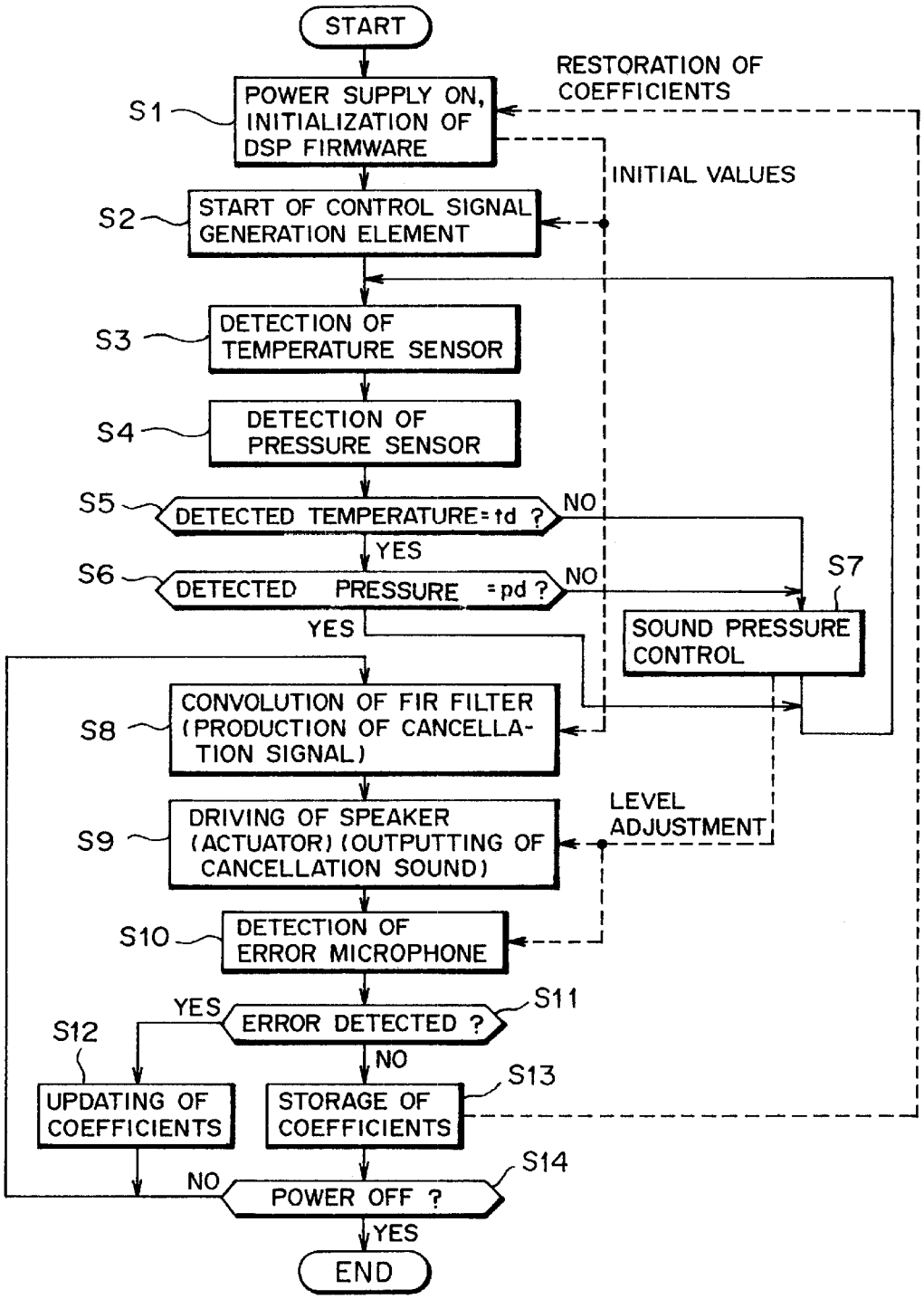
FIG. 6 is a flow chart illustrating operation of the acoustic cooling system with a noise reduction function of FIG. 3.

In the following, operation of the acoustic cooling system 1 of the present embodiment having the construction described above is described in detail with reference to the flow chart (steps S1 to S14) shown in FIG. 6. However, since a compression-vaporization cycle of coolant by the acoustic compressor 110, condenser 120 and carburetor 130 is similar to that of the typical acoustic cooling system described hereinabove, overlapping detailed description of it is omitted here, and only operation regarding the noise reduction function is described below.

First, when the power supply 14 is made available, the acoustic cooling system 1 initializes the DSP firmware mentioned above (step S1) and starts the control signal generation element 15 (step S2). Consequently, a driving control signal of a predetermined frequency is supplied to the acoustic driver 112 through the amplifier 16 so that a sound wave of a predetermined wavelength is forwarded from the acoustic driver 112 into the chamber 111. It is to be noted that an initial value for cancellation signal production is supplied to the FIR filter 34.

Consequently, in the chamber 111, pressure information and temperature information of the coolant in the cooling control system 11 are detected by the pressure sensor 17 and the temperature sensor 18 (steps S3 and S4) and converted into digital signals by the corresponding A/D converters 19 and 20, respectively. The resulting digital signals are subtracted from respective estimated values by the subtractors 21 and 22, and the resulting difference signals are outputted to the amplification control element 23.

The amplification control element 23 discriminates based on the difference signals inputted thereto from the subtractors 21 and 22 whether or not the pressure and the temperature of the coolant in the chamber 111 are equal to a predetermined pressure pd and a predetermined temperature td, respectively, or in other words, whether or not the difference signals are equal to zero (steps S5 and S6). If any of the difference signals is not equal to zero, then the amplification control element 23 adjusts the amplification factor of the amplifier 16, that is, the signal level of the driving control signal to the acoustic driver 112, to control the volume of the acoustic driver 112 so that both of the difference signals may be zero (from the NO route of step S5 or S6 to step S7).

It is to be noted that, if the pressure and the temperature of the coolant in the chamber 111 are equal to the predetermined pressure pd and the predetermined temperature td, respectively, then the amplification control element 23 does not perform adjustment of the amplification of the amplifier 16. Consequently, the signal level of the driving control signal to the acoustic driver 112 is maintained (the YES routes of steps S5 and S6).

On the other hand, if the acoustic driver 112 is driven with the driving control signal produced by the control signal generation element 15 as described above, then the cancellation signal production element 24 of the noise control system 12 produces a cancellation signal for cancelling driving noise of the acoustic driver 112 based on the driving control signal and the initial value for cancellation signal production which was supplied to the noise control system 12 upon initialization of the DSP firmware described above.

More particularly, in the cancellation signal production element 24, the low-pass filter 29 filters the driving control signal to the acoustic driver 112 to remove unnecessary signals from the driving control signal and the A/D converter 30 converts the resulting signal from the low-pass filter 29 into a digital signal, and then the FIR filter 34 performs convolution processing described above for the resulting digital signal to simulate the noise transmission signal when driving noise of the acoustic driver 112 is transmitted to the speaker 13A, that is, the noise waveform of driving noise at the speaker 13A, to produce a cancellation signal mentioned above which has a signal waveform opposite in phase to the noise waveform (step S8).

The cancellation signal produced in this manner is converted into an analog signal by the D/A converter 32, and unnecessary signals are removed from the analog signal by the low-pass filter 33. The resulting signal from the low-pass filter 33 is amplified by the amplifier 25 and supplied to the speaker 13A. Here, in the present embodiment, if the amplification factor of the amplifier 16 is changed to change the signal level of the driving control signal as described above (refer to step S7), then also the amplification factor of the amplifier 25 is changed following (in synchronism with) the change, thereby to change the signal level of the cancellation signal thus produced.

For example, if the amplification control element 23 raises (drops) the signal level of the driving control signal to raise (drop) the volume of the acoustic driver 112 in order to raise (drop) the pressure/temperature of the coolant in the chamber 111, then the amplification factor of the amplifier 25 is raised (dropped) in response to the rise (drop) of the signal level of the driving control signal then and also the signal level of the cancellation signal to be outputted to the speaker 13A is raised (dropped).

Then, the speaker 13A converts the cancellation signal, whose signal level has been adjusted by the amplifier 25 in this manner, into a sound wave and outputs the sound wave as cancellation sound for the driving noise of the acoustic driver 112 (step S9). In other words, the noise control system 12 in the present embodiment raises/drops the volume of the cancellation sound to be forwarded from the speaker 13A in response to a rise/drop of the volume of the acoustic driver 112.

Further, in this instance, in the noise control system 12, the error microphone 13B supervises presence or absence of remaining noise which has not been cancelled by the cancellation sound outputted in such a manner as described above (steps S10 and S11). If remaining noise (an error signal) is detected (when the discrimination in step S11 is YES), then the error signal is outputted to the coefficient adjustment element 35 of the adaptive control element 31 through the amplifier 26, low-pass filter 27 and A/D converter 28.

In this instance, however, when the error signal is amplified by the amplifier 26, the signal level thereof is adjusted to an optimum level (to a level with which the input/output gain of the noise control system 12 is controlled to 1) by the amplifier 26 as the amplification factor of the amplifier 26 is controlled in accordance with the driving control signal to the acoustic driver 112 together with the amplification factor of the amplifier 25. Consequently, the error signal of the optimum level is supplied to the coefficient adjustment element 35.

The coefficient adjustment element 35 thus adjusts (updates) the values of the tap coefficients ($h_0, h_1, \ldots h_{N-1}$) to be multiplied by the multipliers 34B of the FIR filter 34 in response to the inputted error signal so that the error signal may be reduced to zero by a cancellation signal to be produced next (step S12). The FIR filter 34 thus convolutes the driving control signal using the updated tap coefficients to produce a new cancellation signal for reducing the error signal to zero.

Consequently, even if the noise transmission system suddenly changes by a large amount so that remaining noise which cannot be cancelled is produced, the FIR filter 34 can follow up the change rapidly to produce a cancellation signal having an optimum noise cancellation characteristic with which remaining noise is normally controlled to zero.

On the other hand, if no error signal is detected by the error microphone 13B, then since this signifies that driving noise of the acoustic driver 112 is cancelled substantially fully by the cancellation sound outputted from the speaker 13A, updating of the tap coefficients by the coefficient adjustment element 35 is not performed, but the tap coefficients then are stored into a memory (not shown) or the like in the DSP (from the NO route of step S11 to step S13), and the FIR filter 34 produces a cancellation signal having a signal waveform the same as that of the cancellation signal produced in the preceding operation cycle. It is to be noted that the tap coefficients stored in such a manner as described above are restored and used as initial values for the FIR filter 34 when the power supply 14 is made available next time.

Then, the noise control system 12 repetitively performs the convolution of the driving control signal (production of a cancellation signal), detection of an error signal and updating processing of the tap coefficients to adaptively control production and outputting of cancellation sound so that driving noise of the acoustic driver 112 may always be minimized unless the power supply 14 is turned off (NO route of step S14). It is to be noted that, if the power supply 14 is turned off, then all processing is stopped (ended) (YES route of step S14).

As described above, with the acoustic cooling system 1 with a noise reduction function of the present first embodiment, even if the volume of the acoustic driver 112 is changed, since the signal level of the error signal produced by the cancellation signal production element 24 is adjusted in response to the signal level of the driving control signal then by the amplifier 25 of the variable amplification factor type, in whatever manner the volume of the acoustic driver 112 changes, cancellation sound of an optimum level corresponding to the volume of the acoustic driver 112 can be outputted following up the change.

Accordingly, irrespective of the driving condition of the acoustic driver 112, driving noise of the acoustic driver 112 can be reduced very efficiently. Further, in the present embodiment, since the noise transmission system is simulated to produce the cancellation signal by performing convolution processing for the driving control signal to the acoustic driver 112, or in other words, since the driving control signal to the acoustic driver 112 is inputted to the adaptive control element 31, a possible time delay of the adaptive control can be suppressed to the minimum. Accordingly, a cancellation signal having an optimum noise cancellation characteristic can be produced on the real time basis following up a change of the driving noise of the acoustic driver 112 rapidly. Consequently, the noise reduction capability is improved remarkably.

Further, in the present embodiment, since the FIR filter 34 is formed from hardware including the delay elements 34A, multipliers 34B and adder 34C, the processing speed of the convolution processing itself is high, and consequently, it is possible to simulate the noise transmission system on the real time basis and with fidelity to cancel the driving noise of the acoustic driver 112 with a very high degree of accuracy. Further, since the FIR filter 34 having such a construction as described above is employed, it is facilitated to form the adaptive control element 31 as a DSP, which contributes very much to miniaturization of the noise reduction function.

Besides, in the present embodiment, since, if remaining noise which has not been cancelled by cancellation sound outputted from the speaker 13A is detected by the error microphone 13B, then the coefficients of the FIR filter 34 are adjusted by the coefficient adjustment element 35 so that the remaining noise may be reduced to zero, even if the signal waveform of the driving noise of the acoustic driver 112 suddenly changes by a large amount, the driving noise can be minimized following up the change rapidly and with certainty, which contributes to further improvement of the noise reduction capability.

Further, in the present embodiment, since the signal level of the error signal detected by the error microphone 13B and used as a signal for tap coefficient adjustment of the FIR filter 34 is automatically adjusted in response to the volume of the acoustic driver 112 by the amplifier 26 of the variable amplification factor type, in whatever manner the volume of the acoustic driver 112 changes, the error signal level is always adjusted to an optimum level (a level with which the input/output gain of the noise control system 12 is controlled to 1) following up the change. Consequently, the adaptive control upon production of the cancellation signal is stabilized, and the reliability of the noise reduction function is improved remarkably.

Furthermore, in the embodiment described above, since the subtractors 21 and 22 and the amplification control element 23 of the cooling control system 11 and the adaptive control element 31 of the noise control system 12 are formed as a single DSP, miniaturization of the entire apparatus can be achieved readily.

b-2. Second Embodiment

Figure 7:
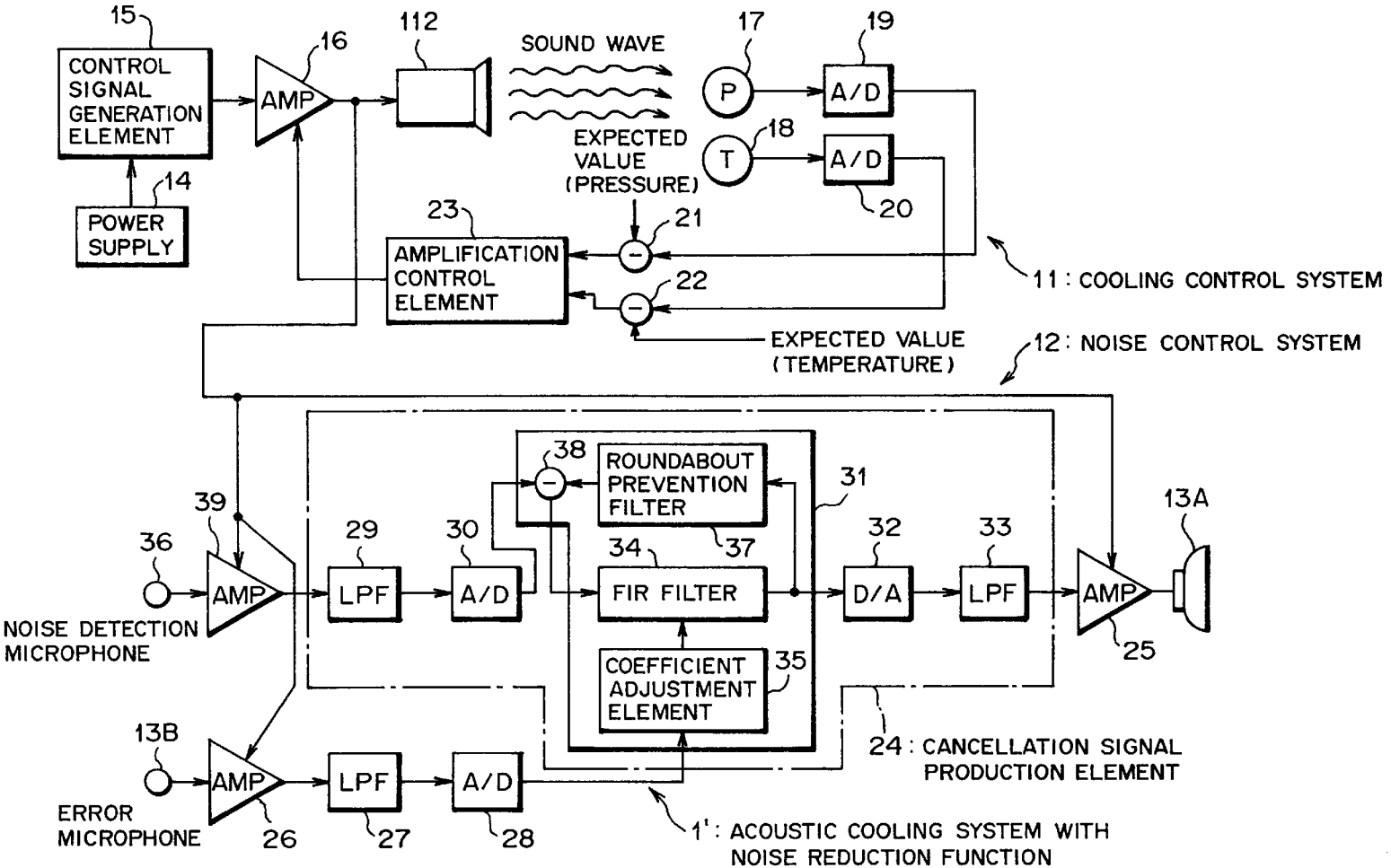
FIG. 7 is a block diagram showing a construction of part of another acoustic cooling system with a noise reduction function according to a second preferred embodiment of the present invention.

FIG. 7 shows in block diagram a construction of part of an acoustic cooling system with a noise reduction function according to a second preferred embodiment of the present invention. The acoustic cooling system 1' shown in FIG. 7 is a modification to and includes common components to those of the acoustic cooling system 1 shown in FIG. 4, but is different principally in that the noise control system 12 additionally includes a noise detection microphone 36 and an amplifier (AMP) 39 while the adaptive control element 31 additionally includes a roundabout prevention filter 37 and a subtractor 38 and an output of the noise detection microphone 36 is inputted to the adaptive control element 31 of the cancellation signal production element 24 through the amplifier 39, low-pass filter 29 and A/D converter 30.

It is to be noted that also the subtractors 21 and 22 and the amplification control element 23 of the cooling control system 11 and the adaptive control element 31 of the noise control system 12 in the present embodiment are formed (as firmware) from a single DSP (digital signal processor). Further, the acoustic cooling system 1' has a general construction similar to that shown in FIG. 3.

The noise detection microphone (noise detection element) 36 detects driving noise of the acoustic driver 112 as a noise signal. It is to be noted that the noise detection microphone 36 is actually disposed, for example, as indicated by a broken line in FIG. 3, in the proximity of the acoustic driver 112 of the acoustic compressor 110 so that it can directly detect noise actually generated by the acoustic driver 112.

The amplifier 39 amplifies the noise signal detected by the noise detection microphone 36. Also for the amplifier 39, an amplifier of the variable amplification factor type is employed similarly to the amplifiers 16, 25 and 26 so that the signal level of the noise signal can be adjusted by controlling the amplification factor of the amplifier 39 in accordance with a driving control signal to the acoustic driver 112. In short, the amplifier 39 has a function as a noise signal level adjustment element for adjusting the signal level of the noise signal to be inputted to the cancellation signal production element 24 in accordance with the driving control signal to the acoustic driver 112.

Further, the roundabout prevention filter (simulation noise signal production element) 37 of the adaptive control element 31 of the cancellation signal production element 24 simulates a cancellation sound transmission system (echo component) when cancellation sound outputted from the speaker 13A is transmitted in a roundabout way to the noise detection microphone 36 based on a cancellation signal produced by the FIR filter 34 to produce an echo signal (simulation noise signal). It is to be noted that the roundabout prevention filter 37 has a similar construction to that of the FIR filter 34 and performs convolution processing for the cancellation signal to simulate the cancellation sound transmission system to produce an echo signal.

Furthermore, the subtractor 38 calculates a difference between the noise signal detected by the noise detection microphone 36 and the echo signal produced by the roundabout prevention filter 37 to produce a difference signal. In the present second embodiment, the difference signal obtained by the subtractor 38 is inputted to the FIR filter 34.

In particular, the cancellation signal production element 24 in the present second embodiment does not produce a cancellation signal based on the driving control signal to the acoustic driver 112 as in the first embodiment, but simulates, based on the difference signal between the noise signal detected by the noise detection microphone 36 and the echo signal produced by the subtractor 38, the noise transmission system when driving noise of the acoustic driver 112 is transmitted to the speaker 13A to produce a cancellation signal for cancelling the driving noise.

Figure 8:
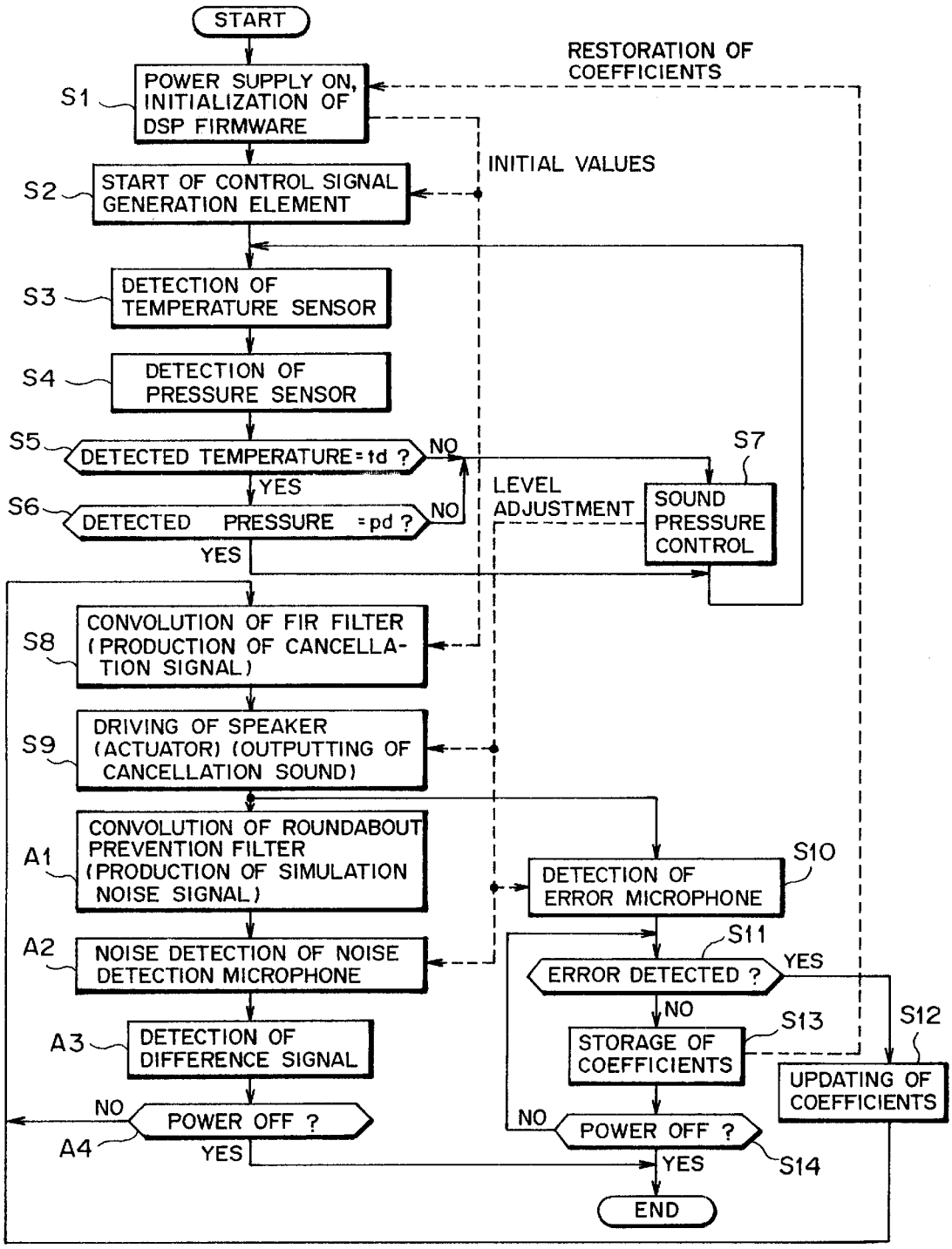
FIG. 8 is a flow chart illustrating operation of the acoustic cooling system with a noise reduction function of FIG. 7.
Figure 9:
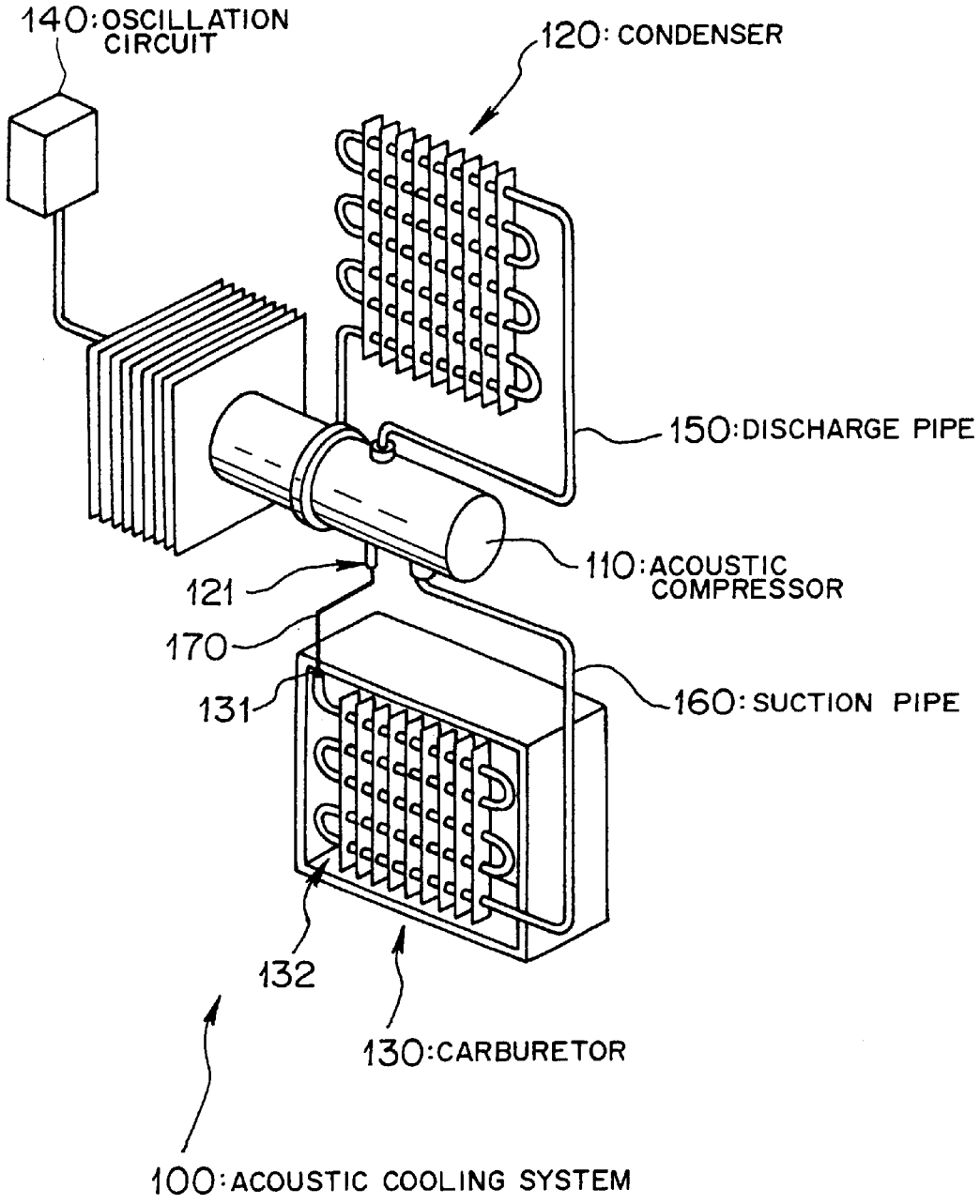
FIG. 9 RELATED ART
FIG. 9 is a perspective view schematically showing an example of an appearance of a typical acoustic cooling system.

In the following, operation of the acoustic cooling system 1' with a noise reduction function of the present second embodiment having such a construction as described above is described in detail with reference to the flow chart (steps S1 to S14 and A1 to A4) shown in FIG. 8. It is to be noted that, in FIG. 8, those steps having like reference numbers to those illustrated in FIG. 6 are similar to the steps described above with reference to FIG. 6, and therefore, overlapping detailed description of them is omitted here and only different steps (A1 to A4) are described below.

First, after the power supply 14 is made available, the cooling control system 11 in the acoustic cooling system 1' controls the volume of the acoustic driver 112 to effect sound pressure control so that the pressure and the temperature of the coolant in the chamber 111 may individually exhibit predetermined values and the FIR filter 34 of the noise control system 12 produces a cancellation signal based on initial values supplied thereto upon initialization of the DSP, and then the signal level of the cancellation signal is adjusted in response to the volume of the acoustic driver 112 and then forwarded as cancellation sound from the speaker 13A in such a manner as described above in connection with the first embodiment (steps S1 to S9).

In this instance, in the adaptive control element 31 of the noise control system 12, the cancellation signal produced by the FIR filter 34 as described above is convoluted by the roundabout prevention filter 37 to simulate the cancellation sound transmission system when cancellation sound forwarded from the speaker 13A is transmitted to the noise detection microphone 36 to produce an echo signal, and actual driving noise (a noise signal) of the acoustic driver 112 is detected by the noise detection microphone 36 (steps A1 and A2).

The signal level of the detected noise signal is adjusted, similarly to the error signal detected by the error microphone 13B, to an optimum level in accordance with the driving control signal to the acoustic driver 112 by the amplifier 39, and unnecessary signal components are removed from the noise signal having the adjusted signal level by the low-pass filter 29. The resulting signal from the low-pass filter 29 is converted into a digital signal by the A/D converter 30, and the digital signal is outputted to the subtractor 38 of the adaptive control element 31.

Then, the subtractor 38 subtracts the echo signal obtained from the roundabout prevention filter 37 from the noise signal to obtain a difference signal (step A3). In this instance, if the power supply 14 of the acoustic cooling system 1' has not been turned off, then the adaptive control element 31 convolutes the difference signal obtained by the subtractor 38 by means of the FIR filter 34 to produce a new cancellation signal so that cancellation sound is forwarded again (NO route of step A4).

In short, the adaptive control element 31 in the present embodiment produces a cancellation signal having a characteristic capable of canceling driving noise of the acoustic driver 112 based on substantially pure driving noise of the acoustic driver 112 which is obtained by removing, from noise detected by the noise detection microphone 36, echo components of cancellation sound outputted from the speaker 13A (that is, by preventing a roundabout of the cancellation sound).

It is to be noted that, if the power supply 14 is off in step A4, then all processing is stopped (ended) (YES route of step A4). Further, if remaining noise (an error signal) is detected by the error microphone 13B after cancellation sound is forwarded from the speaker 13A, the tap coefficients of the FIR filter 34 are adjusted to produce a new cancellation signal so that the error signal may be reduced to zero in a similar manner as in the first embodiment.

As described above, according to the acoustic cooling system 1' with a noise reduction function of the present second embodiment, since, when to produce cancellation sound of an optimum level taking the volume of the acoustic driver 112 into consideration similarly as in the first embodiment, echo components of the cancellation sound are removed from actual noise to simulate an actual noise transmission system with fidelity based on substantially pure driving noise of the acoustic driver 112 to produce cancellation sound, advantages similar to those of the first embodiment can be achieved. Further, comparing with the acoustic cooling system 1 of the first embodiment, the driving noise can be reduced more effectively and with a higher degree of accuracy.

Further, in the present embodiment, since also the signal level of a noise signal detected by the noise detection microphone 36 and used for production of a cancellation signal by the adaptive control element 31 is adjusted in accordance with a driving control signal to the acoustic driver 112, in whatever manner the volume of the acoustic driver 112 changes, the signal level of the noise signal can always be adjusted automatically to an optimum level following up the change. Accordingly, also in the present case, production processing of a cancellation signal is stabilized, and the reliability of the noise reduction function is improved remarkably.

It is to be noted that, while, in the present embodiment, cancellation sound is produced taking echo components of the cancellation sound into consideration as described above, in another case wherein such echo components can be ignored or may not be taken into consideration, similar effects to those described above can be achieved if the roundabout prevention filter 37 and the subtractor 38 are omitted and an output of the noise detection microphone 36 is inputted directly to the FIR filter 34 through the amplifier 39, low-pass filter 29 and A/D converter 30.

c. Others

By the way, while, in the embodiments described above, the FIR filter (non-cyclic digital filter) 34 is used for the adaptive control element 31, similar effects to those described above can be obtained even if a cyclic type digital filter [IIR (Infinite Impulse Response) filter] is used instead. Further, production of a cancellation signal (the cancellation signal production element 24) may not be adaptively controlled using a digital circuit in this manner, but may be controlled using an analog signal (for example, a phase adjustment circuit or the like).

Further, while, in the embodiments described above, the signal levels of the cancellation signal produced by the cancellation signal production element 24, the error signal detected by the error microphone 13B and the noise signal detected by the noise detection microphone 36 are adjusted by changing the amplification factors of the amplifiers 25, 26 and 39, respectively, some other element such as, for example, a variable resistor may be used alternatively to achieve similar effects.

Further, while, in the embodiments described above, production processing of the cancellation signal is adaptively controlled in accordance with the error signal detected by the error microphone 13B so that the error signal may be reduced to zero, for example, where it is known that the influence of a disturbance or the like is not very significant and the noise transmission system does not suddenly exhibit a change by a large amount, the adaptive control system including the error microphone 13B may be omitted to simplify the construction of the noise control system 12.

Furthermore, while, in the embodiments described above, tide subtractors 21 and 22 and the amplification control element 23 of the cooling control system 11 and the adaptive control element 31 of the noise control system 12 are formed (as firmware) from a single DSP (digital signal processor), they need not necessarily be formed from a DSP.

Further, while, in each of the embodiments described above, the acoustic cooling system 1 or 1' is described as being applied to a refrigerator, the application of the acoustic cooling system 1 or 1' is not limited to such particular application and it may be applied to other domestic electric apparatus, electronic apparatus and so forth. Further, in this instance, while the fluid (coolant) contained in the chamber 111 of the acoustic compressor 110 is described as being gas such as freon gas, the medium to be used in the acoustic cooling system of the present invention is not limited to the specific medium, and any fluid may be used only if it functions as a desired cooling medium.

The present invention is not limited to the specifically described embodiment, and variations and modifications may be made without departing from the scope of the present invention.

What is claimed is:

1. An acoustic cooling system with a noise reduction function which includes a vessel in which coolant for cooling a cooling object is contained, a sound source for forwarding a sound wave into the inside of said vessel, and a sound source control element for producing a driving control signal for driving said sound source and outputting the driving control signal to said sound source and wherein said sound source control element controls a driving condition of said sound source to compress the coolant by the sound wave and the cooling object is cooled making use of an endothermic action of the coolant when the compressed coolant is expanded, said acoustic cooling system comprising:

a temperature/pressure monitoring element for monitoring at least one of temperature and pressure in said vessel;

a driving control signal adjustment element for comparing the at least one of the monitored temperature and pressure with predetermined temperature and pressure values, and producing an adjusted driving control signal based on any difference between the monitored and predetermined temperature and pressure;

a cancellation signal production element for producing, in accordance with the driving control signal produced by said sound source control element, a cancellation signal having a characteristic capable of canceling noise which is produced as said sound source is driven;

a cancellation signal level adjustment element for adjusting a signal level of the cancellation signal produced by said cancellation signal production element to produce an adjusted cancellation signal in accordance with the driving control signal produced by said sound source control element, and the adjusted driving control signal; and a cancellation sound outputting element for converting the adjusted cancellation signal into a sound wave and outputting the sound wave as cancellation sound for the noise.

2. An acoustic cooling system with a noise reduction function as claimed in claim 1, further comprising a remaining noise detection element for detecting remaining noise which originates from the noise produced as said sound source is driven and remains without being cancelled by the cancellation sound as a remaining noise signal, said cancellation signal production element including an adaptive control element for adaptively controlling production of the cancellation signal so that the remaining noise signal detected by said remaining noise detection element may be minimized.

3. An acoustic cooling system with a noise reduction function as claimed in claim 2, further comprising a remaining noise signal level adjustment element for adjusting a signal level of the remaining noise signal to be inputted to said adaptive control element in accordance with the driving control signal produced by said sound source control element.

4. An acoustic cooling system with a noise reduction function as claimed in claim 3, wherein said adaptive control element includes an adaptive filter for simulating a noise transmission system when the noise produced as said sound source is driven is transmitted to said cancellation sound outputting element in accordance with the driving control signal produced by said sound source control element to produce the cancellation signal, and a simulation processing control element for controlling the simulation processing of said noise transmission system by said adaptive filter in response to the remaining noise signal detected by said remaining noise detection element.

5. An acoustic cooling system with a noise reduction function as claimed in claim 4, wherein said adaptive filter simulates said noise transmission system to produce the cancellation signal by multiplying a plurality of signals obtained by delaying the driving control signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

6. An acoustic cooling system with a noise reduction function as claimed in claim 2, wherein said adaptive control element includes an adaptive filter for simulating a noise transmission system when the noise produced as said sound source is driven is transmitted to said cancellation sound outputting element in accordance with the driving control signal produced by said sound source control element to produce the cancellation signal, and a simulation processing control element for controlling the simulation processing of said noise transmission system by said adaptive filter in response to the remaining noise signal detected by said remaining noise detection element.

7. An acoustic cooling system with a noise reduction function as claimed in claim 6, wherein said adaptive filter simulates said noise transmission system to produce the cancellation signal by multiplying a plurality of signals obtained by delaying the driving control signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

8. An acoustic cooling system with a noise reduction function which includes a vessel in which coolant for cooling a cooling object is contained, a sound source for forwarding a sound wave into the inside of said vessel, and a sound source control element for producing a driving control signal for driving said sound source and outputting the driving control signal to said sound source and wherein said sound source control element controls a driving condition of said sound source to compress the coolant by the sound wave and the cooling object is cooled making use of an endothermic action of the coolant when the compressed coolant is expanded, said acoustic cooling system comprising:

a noise detection element for detecting noise produced as said sound source is driven as a noise signal;

a temperature/pressure monitoring element for monitoring at least one of temperature and pressure in said vessel;

a driving control signal adjustment element for comparing the at least one of the monitored temperature and pressure with predetermined temperature and pressure values, and producing an adjusted driving control signal based on any difference between the monitored and predetermined temperature and pressure;

a cancellation signal production element for producing a cancellation signal having a characteristic capable of canceling the noise based on the noise signal detected by said noise detection element;

a cancellation signal level adjustment element for adjusting a signal level of the cancellation signal produced by said cancellation signal production element to produce an adjusted cancellation signal in accordance with the driving control signal produced by said sound source control element, and the adjusted driving control signal; and a cancellation sound outputting element for converting the adjusted cancellation signal into a sound wave and outputting the sound wave as cancellation sound for the noise.

9. An acoustic cooling system with a noise reduction function as claimed in claim 8, further comprising a noise signal level adjustment element for adjusting a signal level of the noise signal to be inputted to said cancellation signal production element in accordance with the driving control signal produced by said sound source control element.

10. An acoustic cooling system with a noise reduction function as claimed in claim 9, further comprising a remaining noise detection element for detecting remaining noise which originates from the noise produced as said sound source is driven and remains without being cancelled by the cancellation sound as a remaining noise signal, said cancellation signal production element including an adaptive control element for adaptively controlling production of the cancellation signal so that the remaining noise signal detected by said remaining noise detection element may be minimized.

11. An acoustic cooling system with a noise reduction function as claimed in claim 10, further comprising a remaining noise signal level adjustment element for adjusting a signal level of the remaining noise signal to be inputted to said adaptive control element in accordance with the driving control signal produced by said sound source control element.

12. An acoustic cooling system with a noise reduction function as claimed in claim 11, wherein said adaptive control element includes an adaptive filter for simulating a noise transmission system when the noise produced as said sound source is driven is transmitted to said cancellation sound outputting element in accordance with the noise signal detected by said noise detection element to produce the cancellation signal, and a simulation processing control element for controlling the simulation processing of said noise transmission system by said adaptive filter in response to the remaining noise signal detected by said remaining noise detection element.

13. An acoustic cooling system with a noise reduction function as claimed in claim 12, wherein said adaptive filter simulates said noise transmission system to produce the cancellation signal by multiplying a plurality of signals obtained by delaying the noise signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

14. An acoustic cooling system with a noise reduction function as claimed in claim 11, wherein said adaptive control element includes:

a simulation noise signal production element for simulating a noise transmission system when the cancellation sound outputted from said cancellation sound outputting element is transmitted to said noise detection element based on the cancellation signal to produce a simulation noise signal;

an adaptive filter for simulating said noise transmission system based on a difference signal between the noise signal detected by said noise detection element and the simulation noise signal produced by said simulation noise signal production element to produce the cancellation signal; and a simulation processing control element for controlling the simulation processing of said noise transmission system by said adaptive filter in response to the remaining noise signal detected by said remaining noise detection element.

15. An acoustic cooling system with a noise reduction function as claimed in claim 14, wherein said adaptive filter simulates said noise transmission system to produce the cancellation signal by multiplying a plurality of signals obtained by delaying the difference signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

16. An acoustic cooling system with a noise reduction function as claimed in claim 15, wherein said simulation noise signal production element produces the simulation noise signal by multiplying a plurality of signals obtained by delaying the cancellation signal by respective predetermined coefficients and adding the signals obtained by the multiplication.

17. An acoustic cooling system with a noise reduction function as claimed in claim 14, wherein said simulation noise signal production element produces the simulation noise signal by multiplying a plurality of signals obtained by delaying the cancellation signal by respective predetermined coefficients and adding the signals obtained by the multiplication.

18. An acoustic cooling system with a noise reduction function as claimed in claim 10, wherein said adaptive control element includes an adaptive filter for simulating a noise transmission system when the noise produced as said sound source is driven is transmitted to said cancellation sound outputting element in accordance with the noise signal detected by said noise detection element to produce the cancellation signal, and a simulation processing control element for controlling the simulation processing of said noise transmission system by said adaptive filter in response to the remaining noise signal detected by said remaining noise detection element.

19. An acoustic cooling system with a noise reduction function as claimed in claim 18, wherein said adaptive filter simulates said noise transmission system to produce the cancellation signal by multiplying a plurality of signals obtained by delaying the noise signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

20. An acoustic cooling system with a noise reduction function as claimed in claim 10, wherein said adaptive control element includes:

a simulation noise signal production element for simulating a noise transmission system when the cancellation sound outputted from said cancellation sound outputting element is transmitted to said noise detection element based on the cancellation signal to produce a simulation noise signal;

an adaptive filter for simulating said noise transmission system based on a difference signal between the noise signal detected by said noise detection element and the simulation noise signal produced by said simulation noise signal production element to produce the cancellation signal; and a simulation processing control element for controlling the simulation processing of said noise transmission system by said adaptive filter in response to the remaining noise signal detected by said remaining noise detection element.

21. An acoustic cooling system with a noise reduction function as claimed in claim 20, wherein said adaptive filter simulates said noise transmission system to produce the cancellation signal by multiplying a plurality of signals obtained by delaying the difference signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

22. An acoustic cooling system with a noise reduction function as claimed in claim 21, wherein said simulation noise signal production element produces the simulation noise signal by multiplying a plurality of signals obtained by delaying the cancellation signal by respective predetermined coefficients and adding the signals obtained by the multiplication.

23. An acoustic cooling system with a noise reduction function as claimed in claim 20, wherein said simulation noise signal production element produces the simulation noise signal by multiplying a plurality of signals obtained by delaying the cancellation signal by respective predetermined coefficients and adding the signals obtained by the multiplication.

24. An acoustic cooling system with a noise reduction function as claimed in claim 8, further comprising a remaining noise detection element for detecting remaining noise which originates from the noise produced as said sound source is driven and remains without being cancelled by the cancellation sound as a remaining noise signal, said cancellation signal production element including an adaptive control element for adaptively controlling production of the cancellation signal so that the remaining noise signal detected by said remaining noise detection element may be minimized.

25. An acoustic cooling system with a noise reduction function as claimed in claim 24, further comprising a remaining noise signal level adjustment element for adjusting a signal level of the remaining noise signal to be inputted to said adaptive control element in accordance with the driving control signal produced by said sound source control element.

26. An acoustic cooling system with a noise reduction function as claimed in claim 25, wherein said adaptive control element includes an adaptive filter for simulating a noise transmission system when the noise produced as said sound source is driven is transmitted to said cancellation sound outputting element in accordance with the noise signal detected by said noise detection element to produce the cancellation signal, and a simulation processing control element for controlling the simulation processing of said noise transmission system by said adaptive filter in response to the remaining noise signal detected by said remaining noise detection element.

27. An acoustic cooling system with a noise reduction function as claimed in claim 26, wherein said adaptive filter simulates said noise transmission system to produce the cancellation signal by multiplying a plurality of signals obtained by delaying the noise signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

28. An acoustic cooling system with a noise reduction function as claimed in claim 25, wherein said adaptive control element includes:

a simulation noise signal production element for simulating a noise transmission system when the cancellation sound outputted from said cancellation sound outputting element is transmitted to said noise detection element based on the cancellation signal to produce a simulation noise signal;

an adaptive filter for simulating said noise transmission system based on a difference signal between the noise signal detected by said noise detection element and the simulation noise signal produced by said simulation noise signal production element to produce the cancellation signal; and a simulation processing control element for controlling the simulation processing of said noise transmission system by said adaptive filter in response to the remaining noise signal detected by said remaining noise detection element.

29. An acoustic cooling system with a noise reduction function as claimed in claim 28, wherein said adaptive filter simulates said noise transmission system to produce the cancellation signal by multiplying a plurality of signals obtained by delaying the difference signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

30. An acoustic cooling system with a noise reduction function as claimed in claim 29, wherein said simulation noise signal production element produces the simulation noise signal by multiplying a plurality of signals obtained by delaying the cancellation signal by respective predetermined coefficients and adding the signals obtained by the multiplication.

31. An acoustic cooling system with a noise reduction function as claimed in claim 28, wherein said simulation noise signal production element produces the simulation noise signal by multiplying a plurality of signals obtained by delaying the cancellation signal by respective predetermined coefficients and adding the signals obtained by the multiplication.

32. An acoustic cooling system with a noise reduction function as claimed in claim 24, wherein said adaptive control element includes an adaptive filter for simulating a noise transmission system when the noise produced as said sound source is driven is transmitted to said cancellation sound outputting element in accordance with the noise signal detected by said noise detection element to produce the cancellation signal, and a simulation processing control element for controlling the simulation processing of said noise transmission system by said adaptive filter in response to the remaining noise signal detected by said remaining noise detection element.

33. An acoustic cooling system with a noise reduction function as claimed in claim 32, wherein said adaptive filter simulates said noise transmission system to produce the cancellation signal by multiplying a plurality of signals obtained by delaying the noise signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

34. An acoustic cooling system with a noise reduction function as claimed in claim 24, wherein said adaptive control element includes:

a simulation noise signal production element for simulating a noise transmission system when the cancellation sound outputted from said cancellation sound outputting element is transmitted to said noise detection element based on the cancellation signal to produce a simulation noise signal;

an adaptive filter for simulating said noise transmission system based on a difference signal between the noise signal detected by said noise detection element and the simulation noise signal produced by said simulation noise signal production element to produce the cancellation signal; and a simulation processing control element for controlling the simulation processing of said noise transmission system by said adaptive filter in response to the remaining noise signal detected by said remaining noise detection element.

35. An acoustic cooling system with a noise reduction function as claimed in claim 34, wherein said adaptive filter simulates said noise transmission system to produce the cancellation signal by multiplying a plurality of signals obtained by delaying the difference signal by respective predetermined coefficients and adding the signals obtained by the multiplication, and said simulation processing control element adjusts the coefficients of said adaptive filter in response to the remaining noise signal detected by said remaining noise detection element to control the simulation processing of said noise transmission system.

36. An acoustic cooling system with a noise reduction function as claimed in claim 34, wherein said simulation noise signal production element produces the simulation noise signal by multiplying a plurality of signals obtained,by delaying the cancellation signal by respective predetermined coefficients and adding the signals obtained by the multiplication.

37. An acoustic cooling system with a noise reduction function as claimed in claim 35, wherein said simulation noise signal production element produces the simulation noise signal by multiplying a plurality of signals obtained by delaying the cancellation signal by respective predetermined coefficients and adding the signals obtained by the multiplication.

* * * * *